US005787554A

United States Patent [19]

Hashimoto

[11] Patent Number: 5,787,554

[45] Date of Patent: Aug. 4, 1998

[54] DEVICE FOR MAKING A FINE ADJUSTMENT OF A LENGTH OF A PERSONAL ADORNMENT BAND

[75] Inventor: Norio Hashimoto, Tanashi, Japan

[73] Assignee: Citizen Watch Co., Ltd., Tokyo, Japan

[21] Appl. No.: 732,439

[22] PCT Filed: Mar. 15, 1996

[86] PCT No.: PCT/JP96/00689

§ 371 Date: Nov. 5, 1996

§ 102(e) Date: Nov. 5, 1996

[87] PCT Pub. No.: WO96/28064

PCT Pub. Date: Sep. 19, 1996

[30] Foreign Application Priority Data

Mar. 15, 1995 [JP] Japan ..... 7-055307
Feb. 9, 1996 [JP] Japan ..... 8-023705

[51] Int. Cl.[6] ..... A44C 5/18; A44C 5/20; A44C 5/22

[52] U.S. Cl. ..... 24/68 J; 24/265 WS; 24/71 J

[58] Field of Search ..... 63/3, 3.2, 15.62, 63/15.65, 5.1, 9; 24/68 J, 68 R, 70 J, 71 J, 265 WS, 265 EC, 265 BC, 265 R, 68 E, 68 T, 574, 589, 596, 625, 656, 586

[56] References Cited

U.S. PATENT DOCUMENTS

| | | | |
|---|---|---|---|
| Re. 26,584 | 5/1969 | Spence | 24/68 J |
| 1,764,440 | 6/1930 | Gammell et al. | 24/68 J |
| 1,866,165 | 7/1932 | Kraemer | 24/71 J |
| 2,457,200 | 12/1948 | Bikoff | 24/71 J |
| 2,461,309 | 2/1949 | Cedar | 24/71 J X |
| 3,445,900 | 5/1969 | Currat | 24/71 J |
| 4,115,904 | 9/1978 | Zwyssig et al. | 24/68 J X |
| 4,217,681 | 8/1980 | Grohoski et al. | 24/265 WS |
| 4,593,440 | 6/1986 | Tsamas | 24/265 WS |
| 4,675,955 | 6/1987 | Nakamura | 24/68 J X |
| 5,175,912 | 1/1993 | Chevalley et al. | 24/68 J |
| 5,191,685 | 3/1993 | Aoki et al. | 24/68 J X |
| 5,305,503 | 4/1994 | Yamagata | 24/68 J |
| 5,313,691 | 5/1994 | Hashimoto | 24/265 WS X |
| 5,485,659 | 1/1996 | Kachikie et al. | 24/68 J X |
| 5,491,845 | 2/1996 | Takimoto | 24/68 J X |

FOREIGN PATENT DOCUMENTS

| | | |
|---|---|---|
| 60-9801 | 3/1985 | Japan . |
| 6-36740 | 9/1994 | Japan . |

*Primary Examiner*—Peter M. Cuomo
*Assistant Examiner*—Robert J. Sandy
*Attorney, Agent, or Firm*—Dennison, Meserole, Pollack & Scheiner

[57] ABSTRACT

A housing (16) is provided for housing necessary members and to be connected to a personal adornment band (1, 2) at an end of the band. A slide plate (18) is slidably mounted in the housing so as to be moved in a longitudinal direction of the band, and connected to the other end of the band, and a push plate (19, 20) is laterally slidably provided in the housing. Ratchet teeth (37) are formed on the slide plate. A lock projection (41) is formed on the push plate, and a spring (21) is provided for urging the push plate for engaging the projection with one of the ratchet teeth at a position selected from a plurality of positions dependent on the ratchet teeth.

23 Claims, 43 Drawing Sheets

DEVICE FOR MAKING A FINE ADJUSTMENT OF A LENGTH OF A PERSONAL ADORNMENT BAND

TECHNICAL FIELD

The present invention relates to a device for adjusting length of a personal adornment band, and more particularly to an adjusting device for finely adjusting the length of a personal adornment band including a bracelet, and a watch band which are put on a wrist of the user, a necklace put on a neck, and a belt of trousers put around a waist in dependency on change in size of the wrist, neck and waist from the size in the morning and to the size at the evening.

BACKGROUND ART

FIG. 51 shows a conventional watch band having an adjusting device for adjusting the length of the watch band using a hairpin-shaped connecting pin.

In a watch band 201, links 202 and 203 of the band are connected with a hairpin-shaped connecting pin 204. In order to adjust the length of the band, a bifurcated end of the hairpin-shaped connecting pin 204 is pushed by a push rod 205 in the lateral direction of the band and a bent end of the pin 204 is projected to the opposite side of the link 203. The projected end of the pin 204 is gripped by a pair of tweezers 207 so that the pin is pulled out. Thus, the links 202 and 203 are disconnected.

If the link 203 is removed from the band, the length of the band is reduced by the length of the link 203. If another link is inserted between the links 202 and 203, the length of the band is increased by the length of the added link.

FIG. 52 shows another conventional watch band buckle having an adjusting device for adjusting the length of the watch band provided in a triple-folded band buckle.

The band buckle comprises a folding plate member 210 having a bottom plate 211 and a middle plate 212 pivotally connected to an end of the bottom plate 211, and a cover 213. The cover 213 has an upper plate **213*a* and a pair of side plates 214 formed on the both sides of the upper plate 213*a*. Each side plate 214 has a series of adjusting holes 215** formed at a predetermined pitch.

The other end of the bottom plate 211 is pivotally connected to an end link 216A of a first watch band 216. A base end of the cover 213 is pivotally connected to an end link 217A of a second watch band 217 by a spring-loaded connecting pin 219 and the other end of the cover 213 is pivotally connected to the middle plate 212. The adjusting holes 215 are provided to adjust the effective length of the second band 217.

The length of the band is adjusted by changing the hole 215 to be engaged with the connecting pin 219.

However, in the adjusting device of FIG. 51, the length of the band 201 is adjusted only by the width of the link 202. In particular, if the link 202 has a large width in the longitudinal direction of the band, the length of the band is extremely reduced or increased by omitting or adding the link. Therefore, if the user desires to slightly loose the band or tighten the band, the length of the band can not be adjusted so as to meet the requirement of the user.

In the adjusting operation, it is necessary to use the push rod 205 and the tweezers 207. Since such operation requires skilled work, it is very troublesome and difficult for the user to adjust the length of the band.

On the other hand, in the adjusting device of FIG. 52, the length of the band is adjusted with a shorter length than the device of FIG. 51. However, since there is a manufacturing limit to minimize a pitch between the adjusting holes 215, the length of the band can not be sufficiently adjusted in accordance with change of size of the wrist from the size in the morning and to the size at the evening.

Furthermore, it is necessary to use a tool such as a pair of tweezers for engaging the spring-loaded connecting pin 219 with the adjusting holes 215, and for disengaging the pin from the holes. Since such operations require skilled work, the length of the band can not be easily changed.

Consequently, a watch band having a fine adjustment effect is desired.

An object of the present invention is to provide an adjusting device for the length of personal adornment bands such as a watch band, bracelet, necklace and belt where the length of the band is finely adjusted in dependency on change in size of the wrist, neck and waist from the size in the morning and to the size at the evening.

Another object of the present invention is to provide an adjusting device for finely adjusting the length of the personal adornment bands which is easily operated by the user.

DISCLOSURE OF THE INVENTION

According to the present invention, there is provided a device for adjusting length of a personal adornment band comprising a housing connected to the personal adornment band at one end portion thereof, a slide plate slidably mounted in the housing so as to be moved in a longitudinal direction of the band, and connected to the other end of the band, tooth means formed on one of a first movable member and a second movable member provided in the housing, lock means formed on the other movable member, resilient means for engaging tooth means and lock means with each other at a position selected from a plurality of positions dependent on the tooth means.

In an aspect of the present invention, it is possible to integrally form the adjusting device of the length of the band with the buckle having the push plates. The adjusting device comprises the slide plate connected to the end of the band and slidable in the longitudinal direction of the band. The slide plate has a plurality of engaging teeth detachably engaged with the engaging projections of the push plates. The slide plate is slid by disengaging the engaging teeth from the engaging projections of the push plates by or without pushing the push plates. The slide plate is moved to a desired position where the engaging tooth is engaged with the engaging projections so that the length of the band is finely adjusted.

Figure 6:
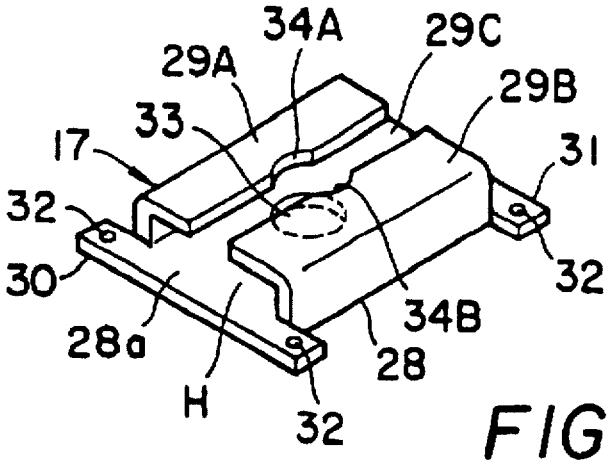
Figure 7:
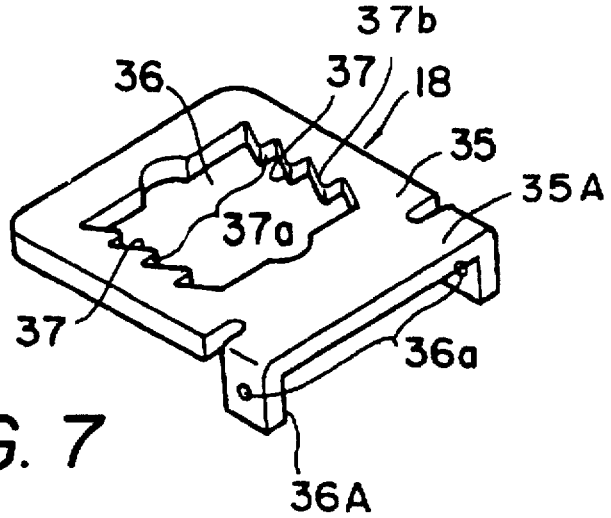
Figure 8:
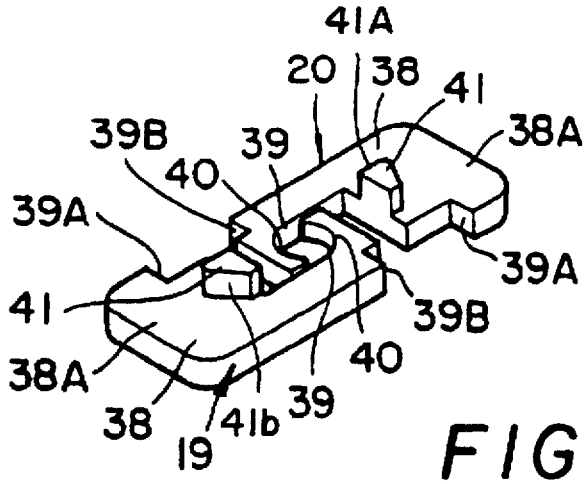
Figure 9:
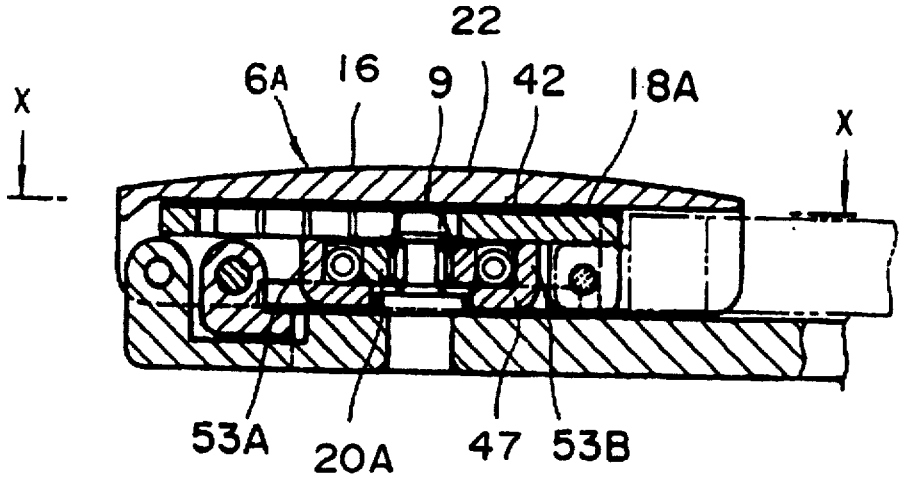
Figure 10:
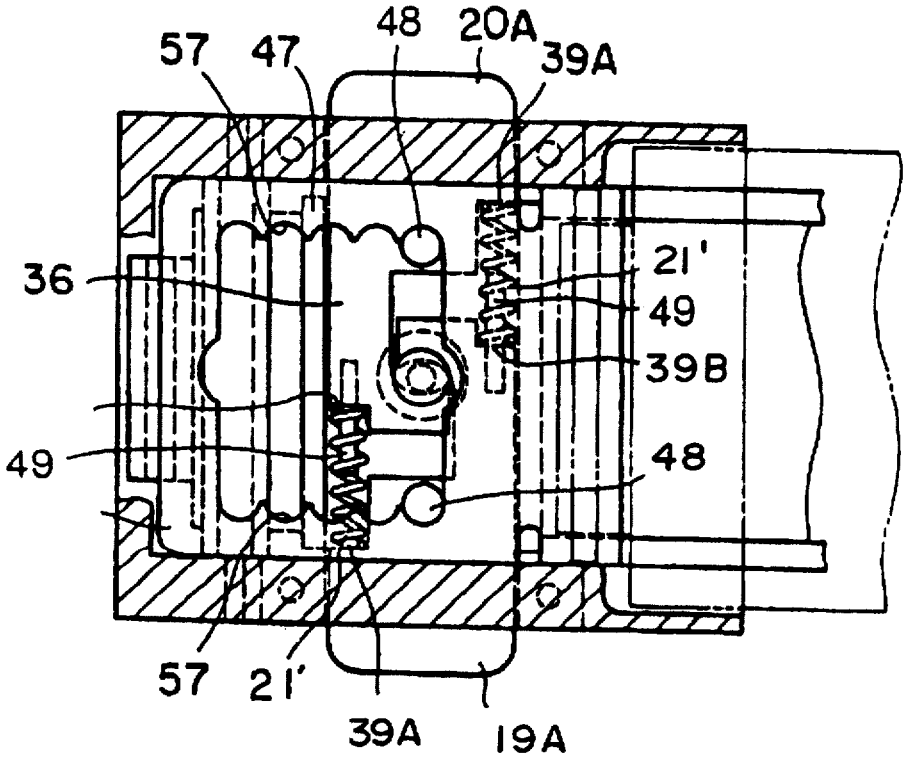
Figure 11:
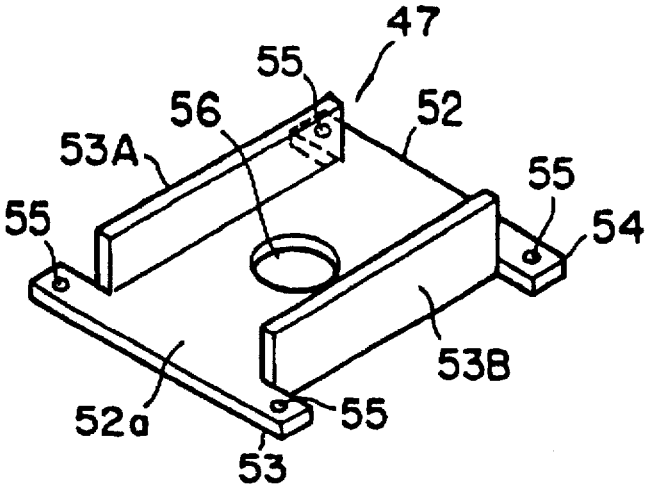
Figure 12:
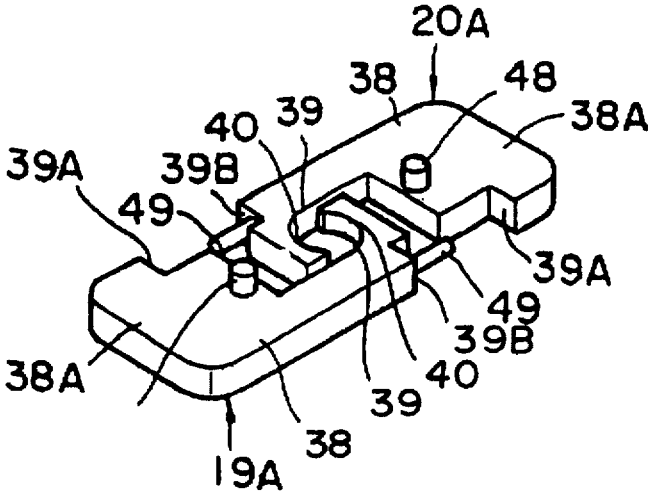
Figure 13:
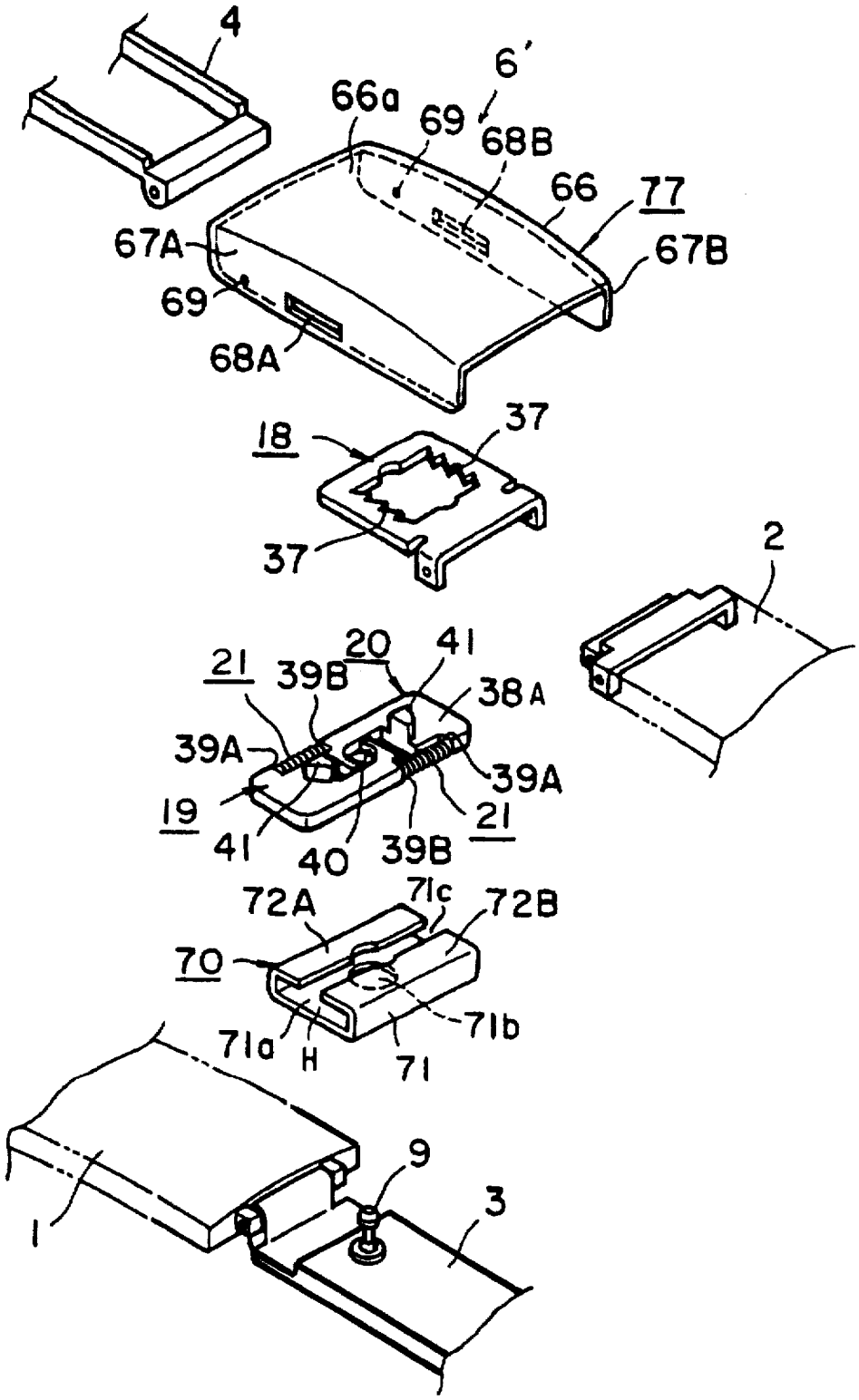
Figure 14:
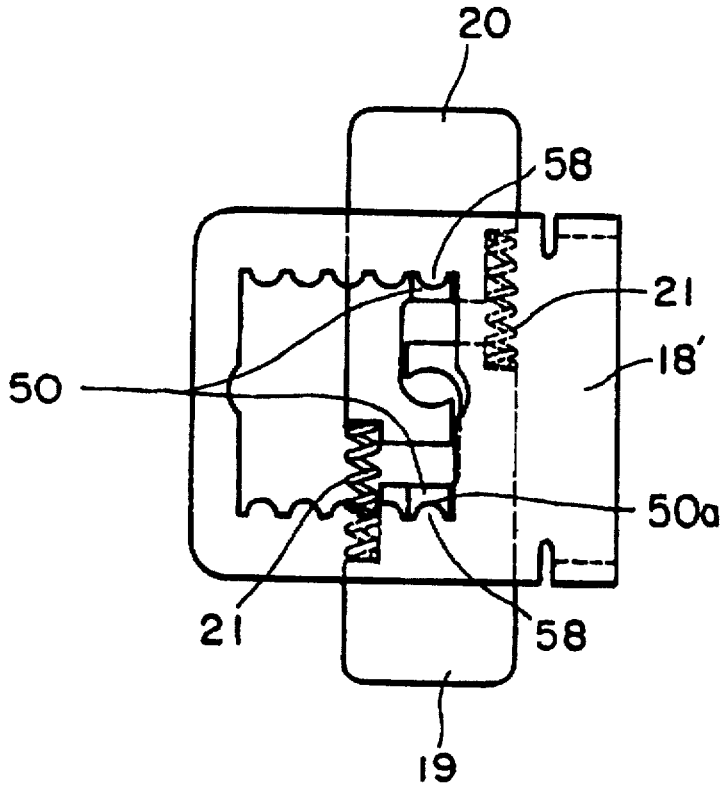
Figure 15:
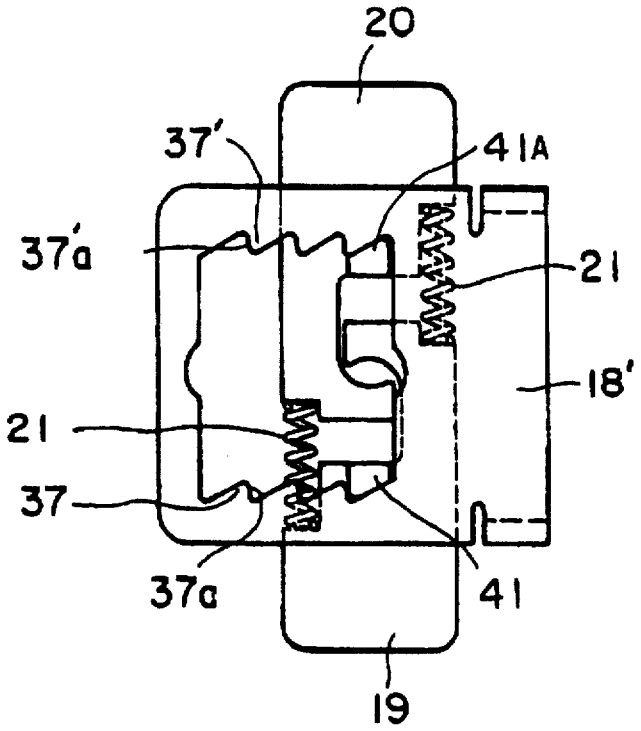
Figure 16:
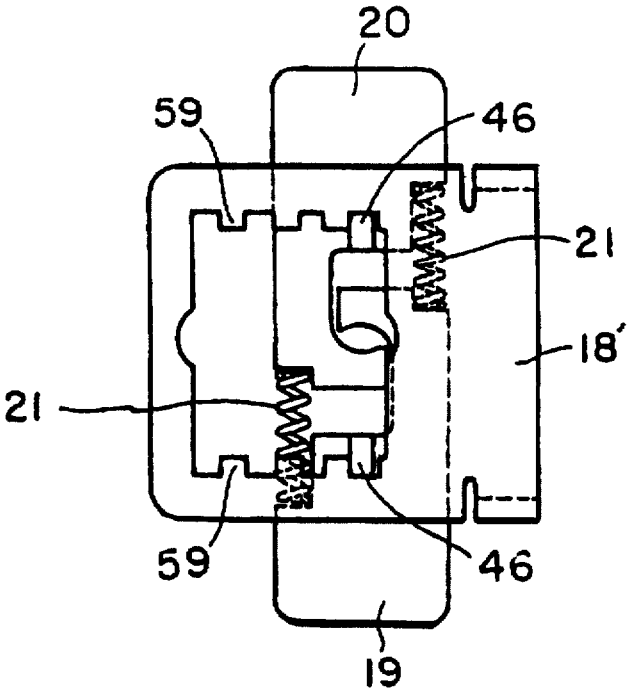
Figure 17:
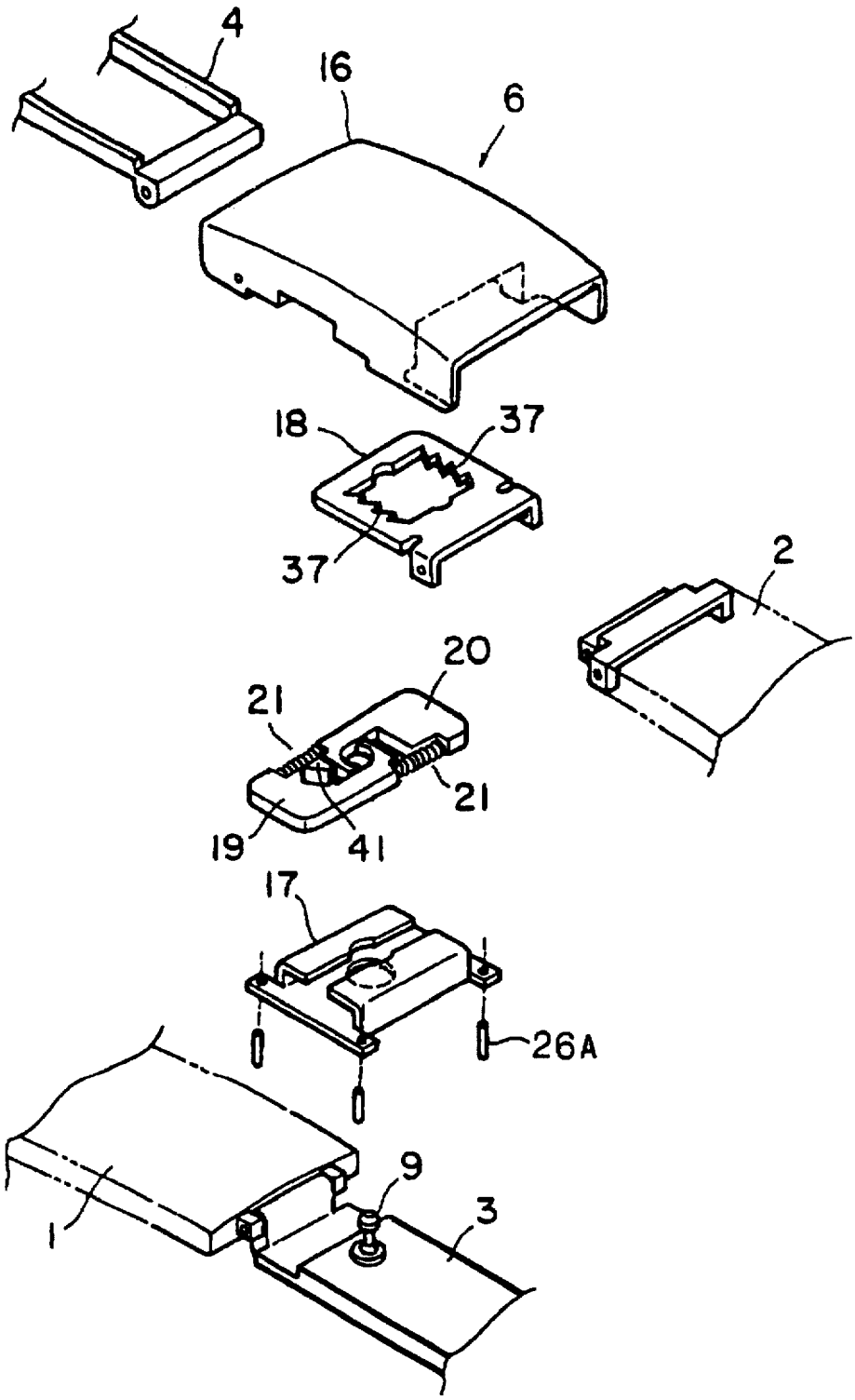
Figure 18:
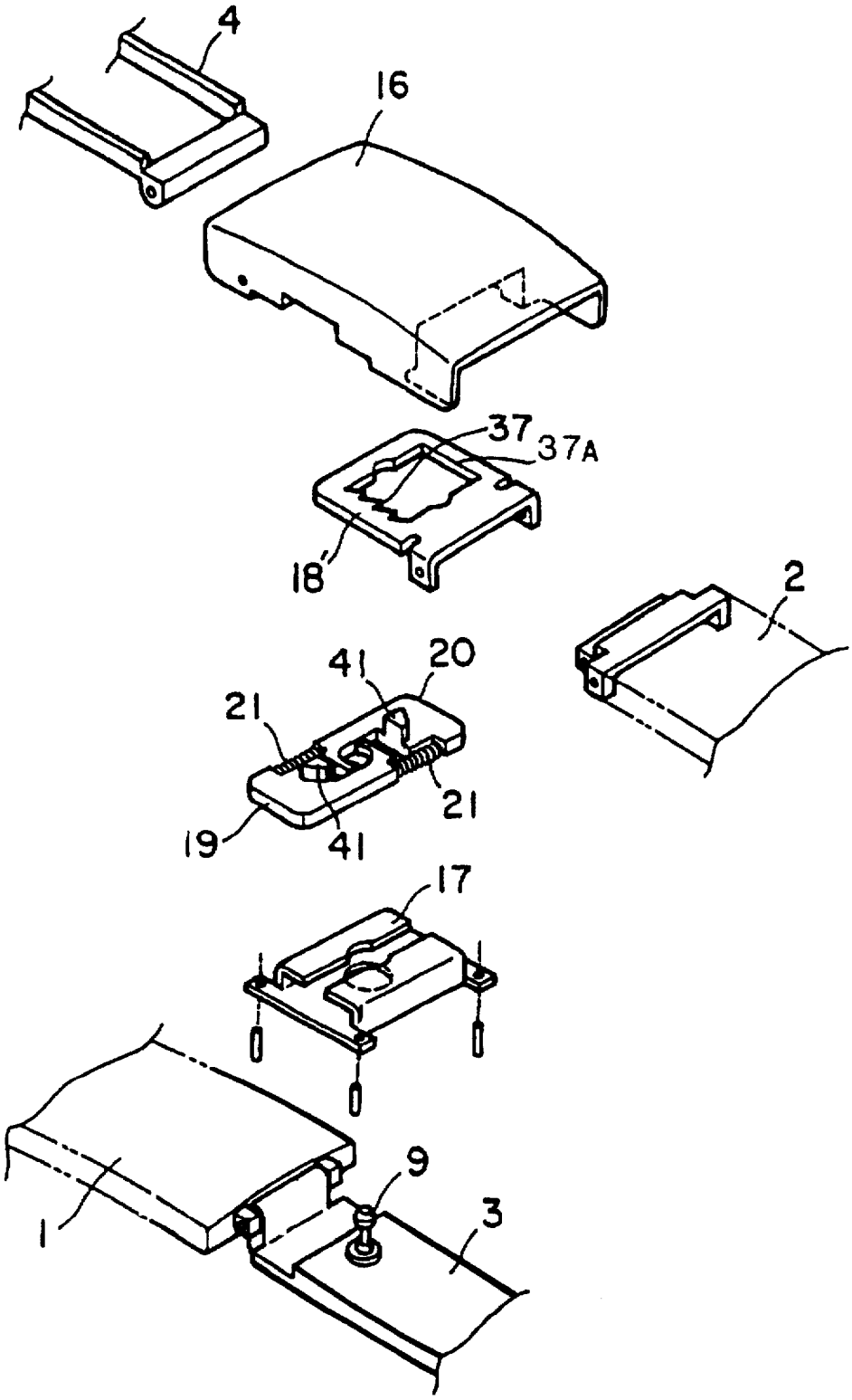
Figure 19:
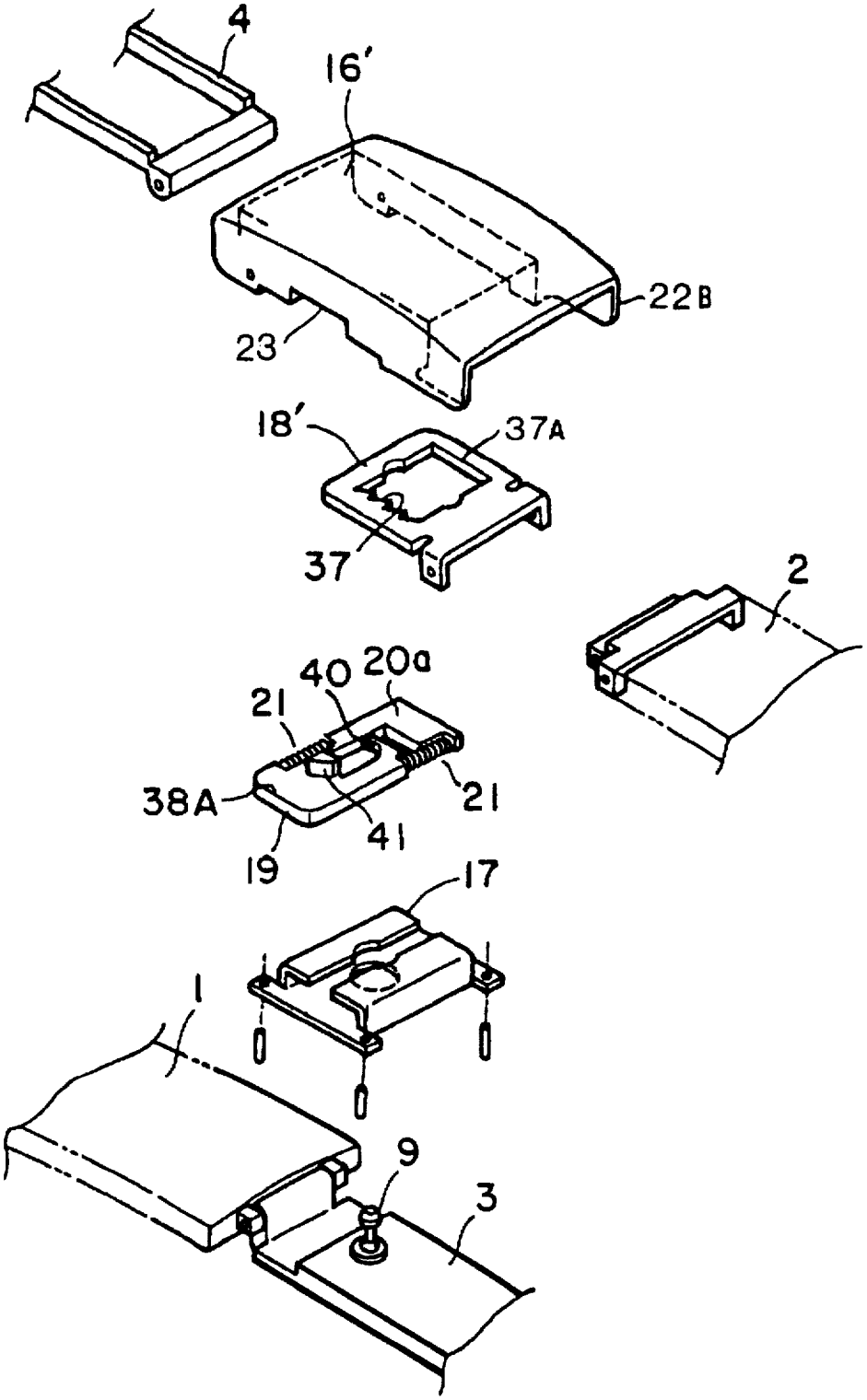
Figure 20:
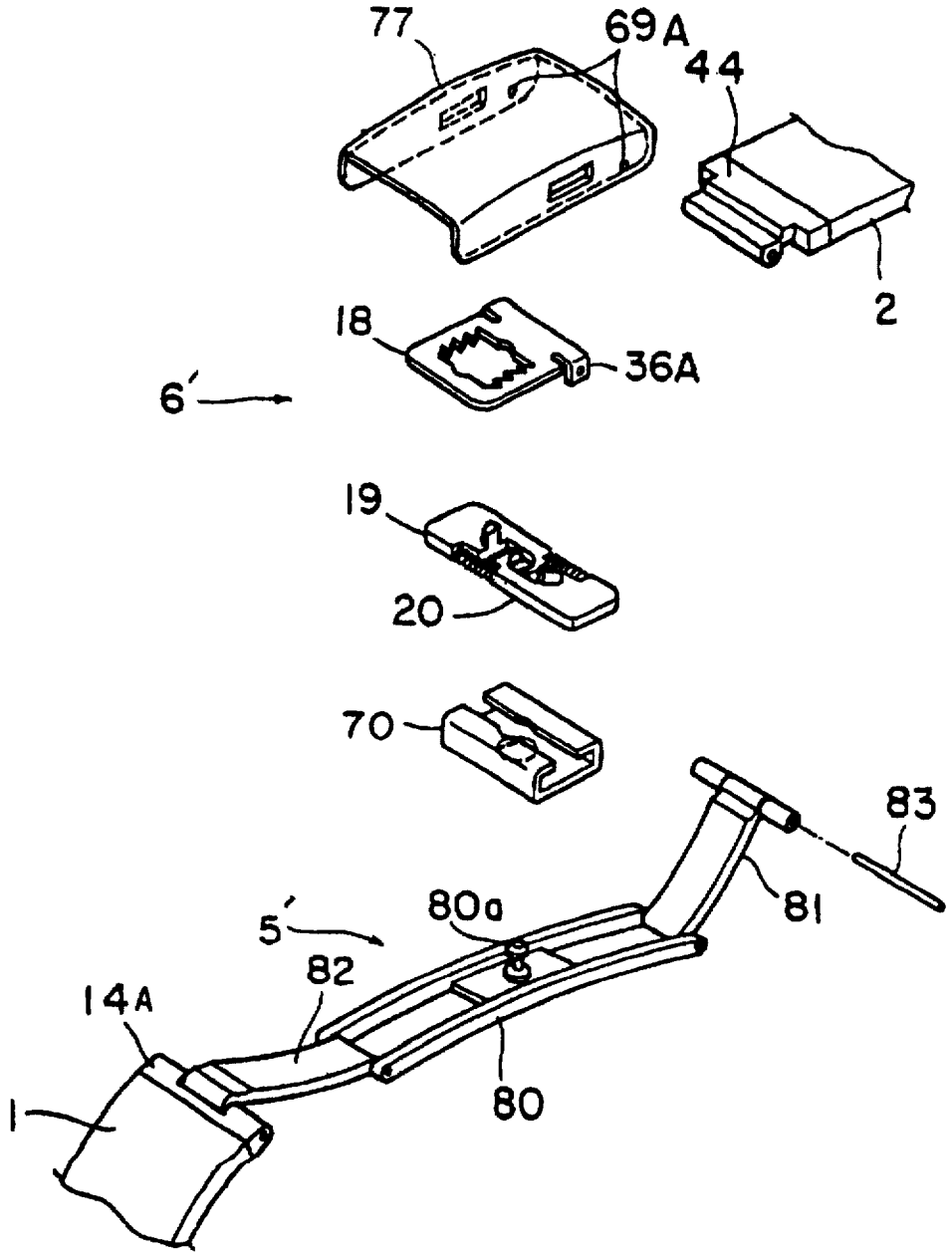
Figure 21:
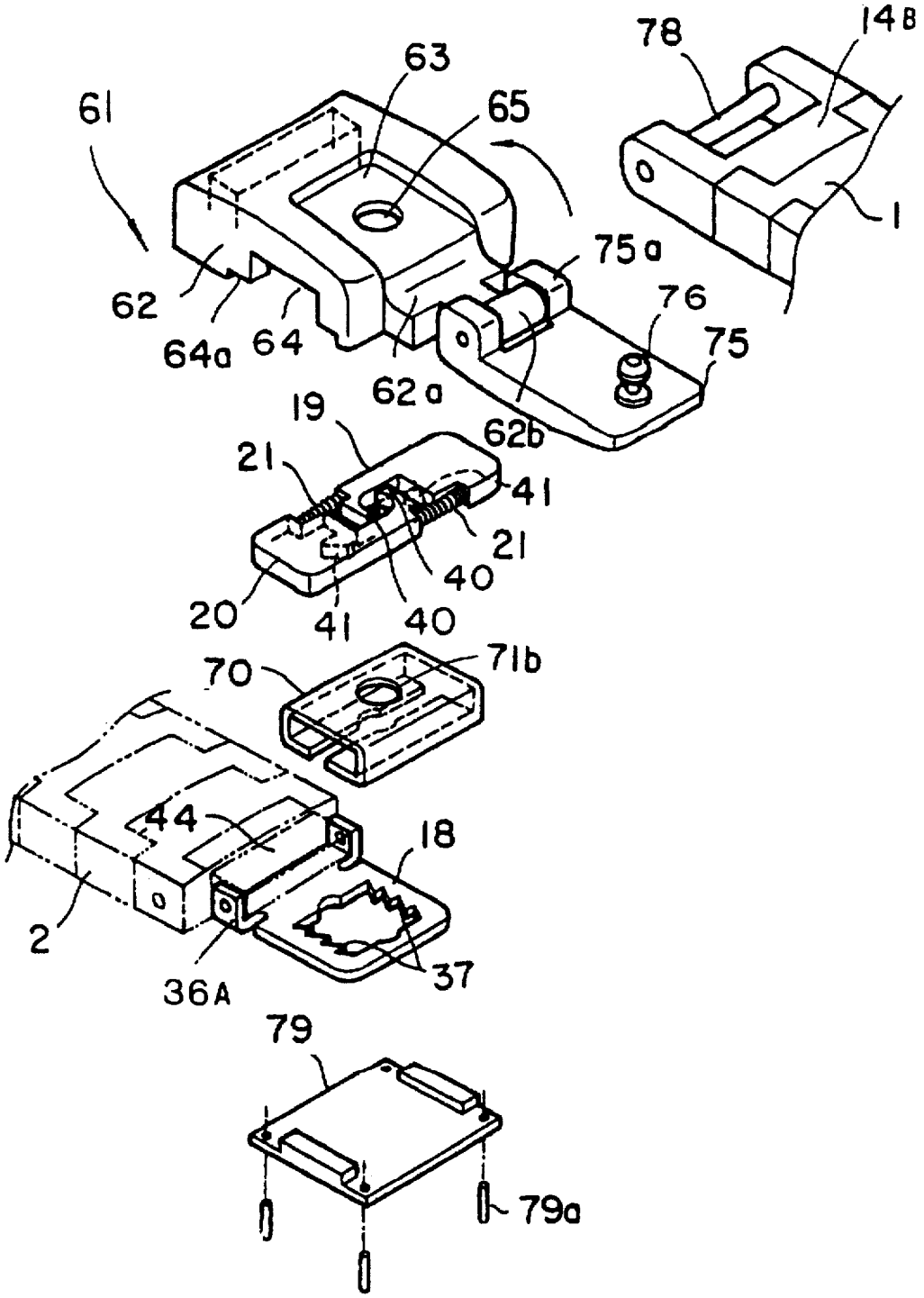
Figure 22:
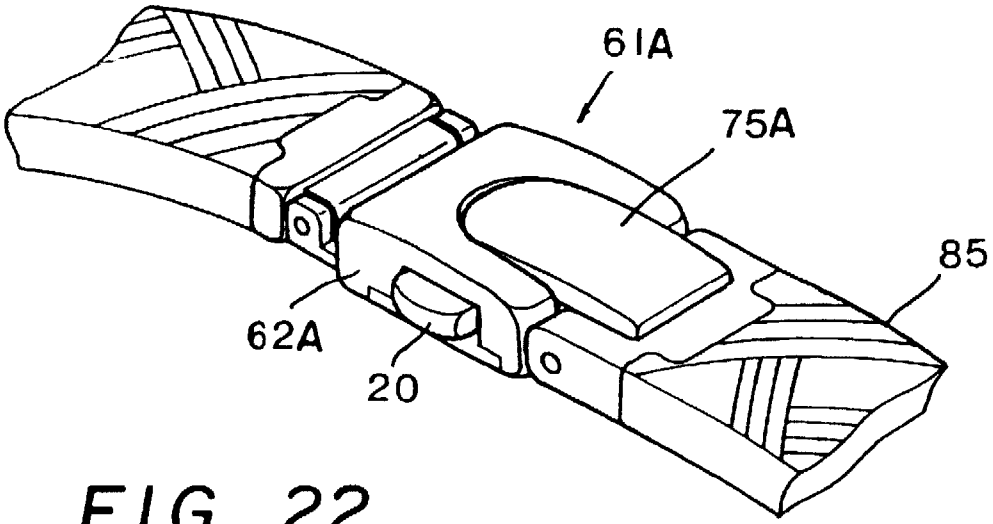
Figure 23:
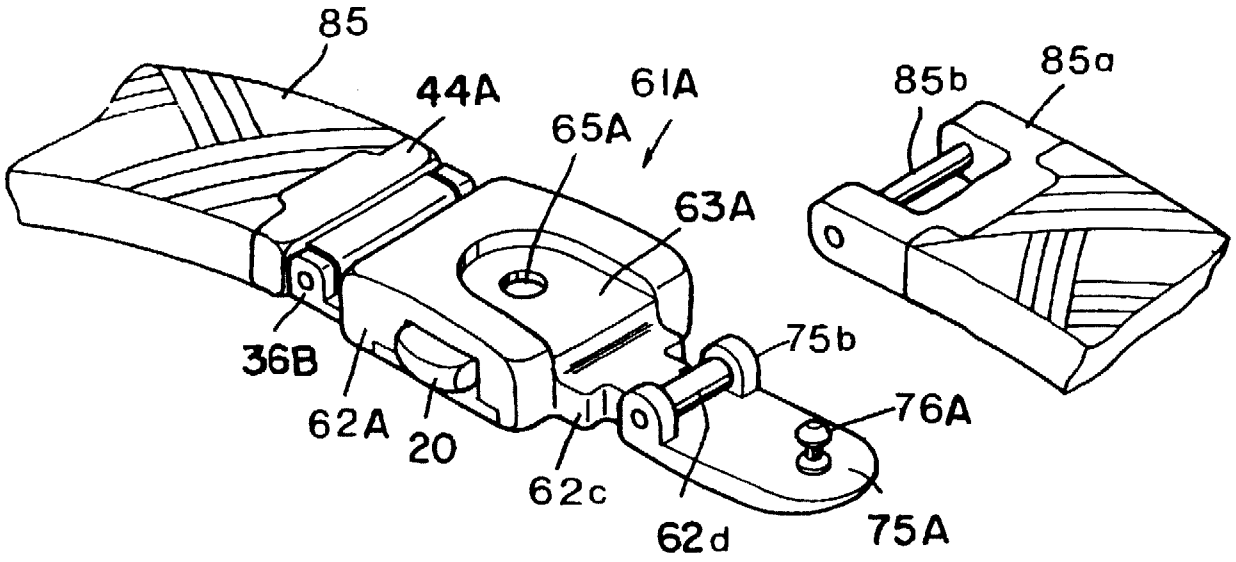
Figure 24:
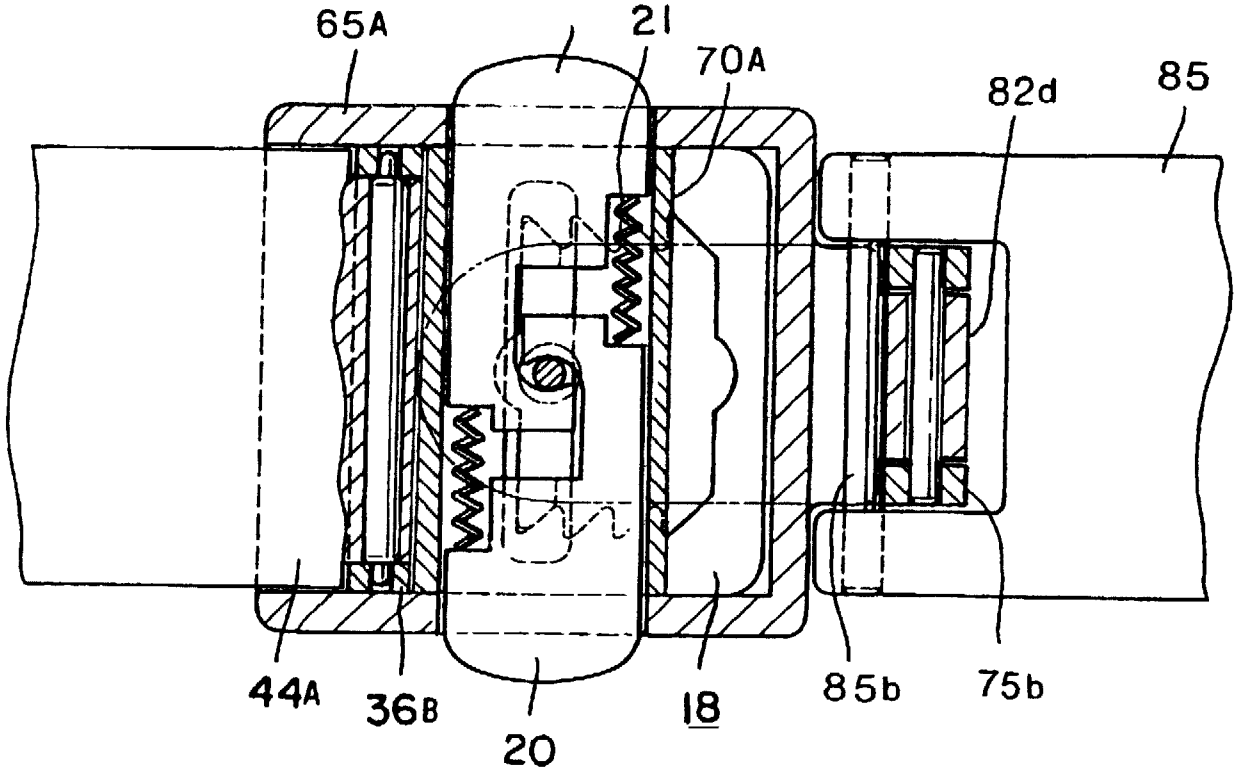
Figure 25:
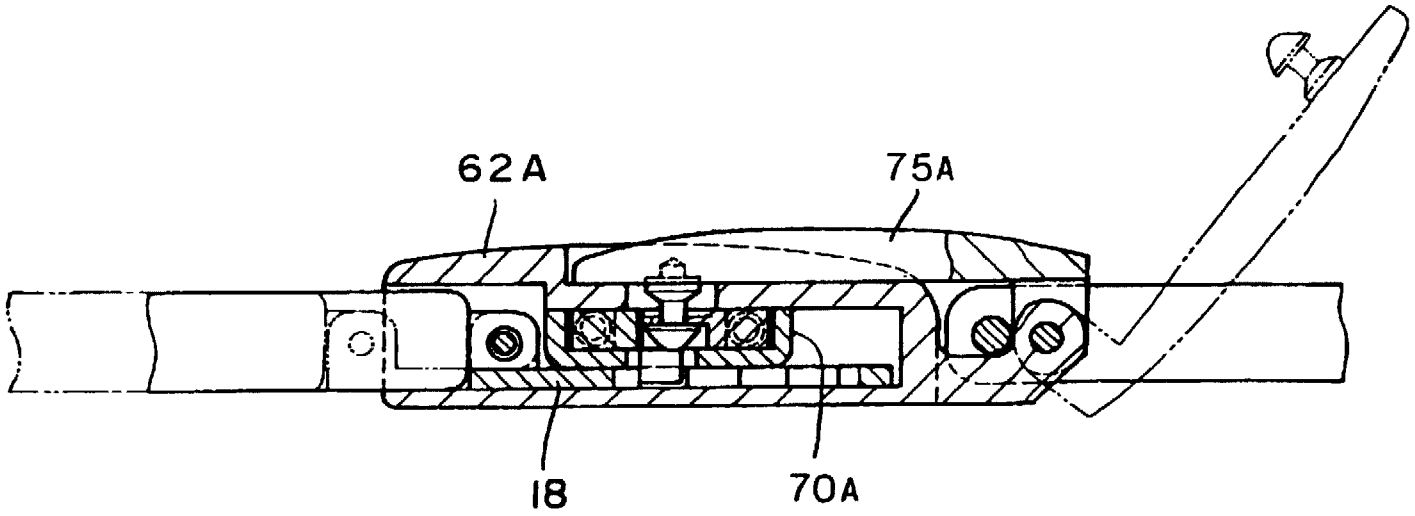
Figure 26:
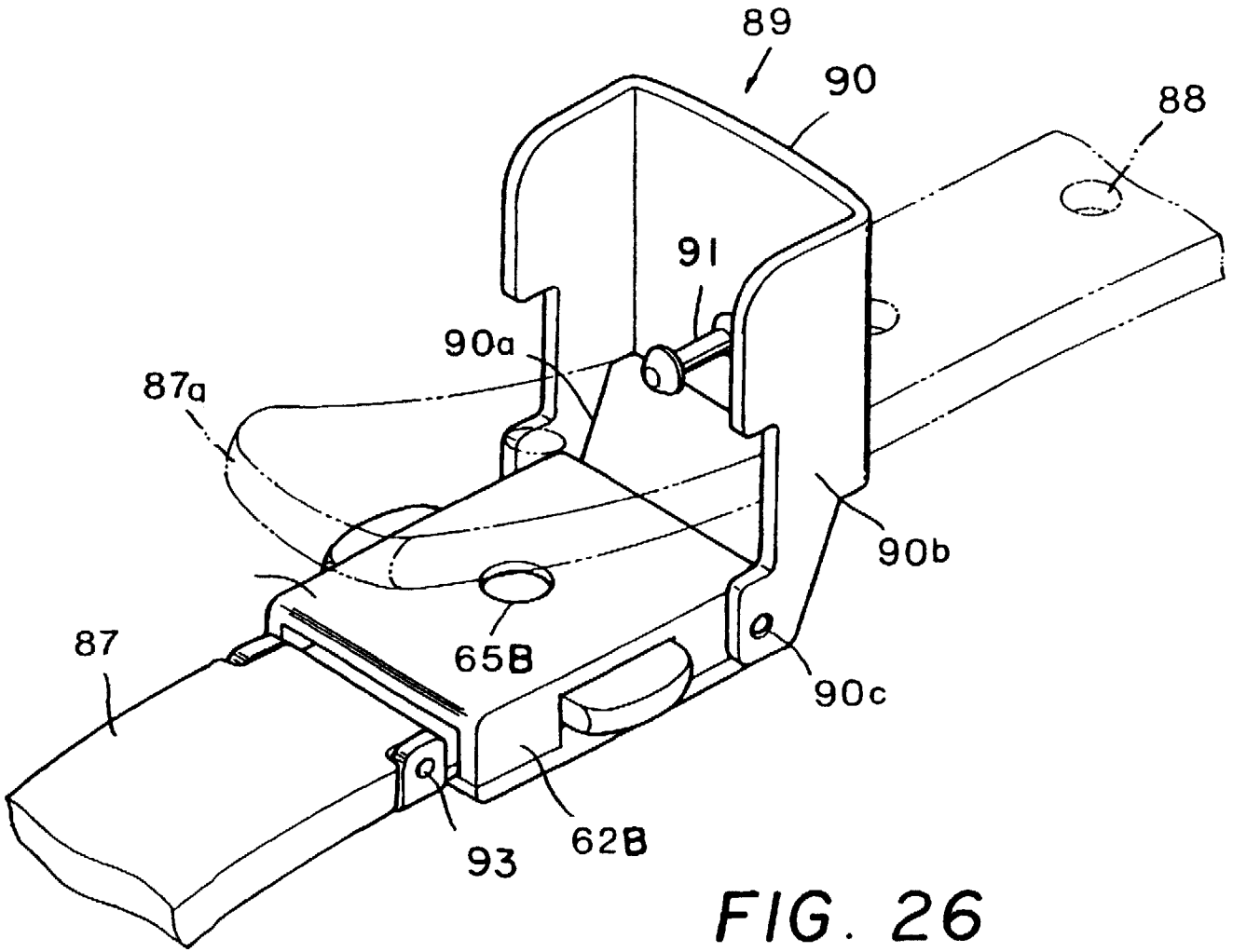
Figure 27:
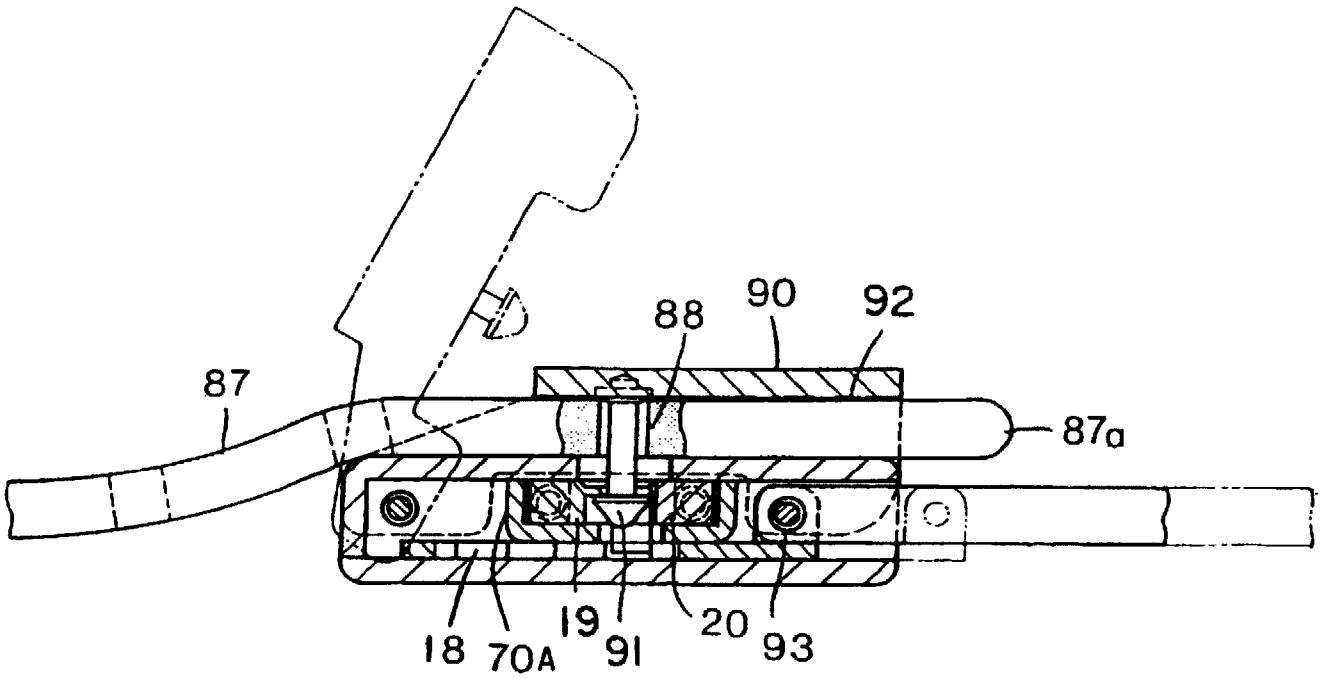
Figure 28:
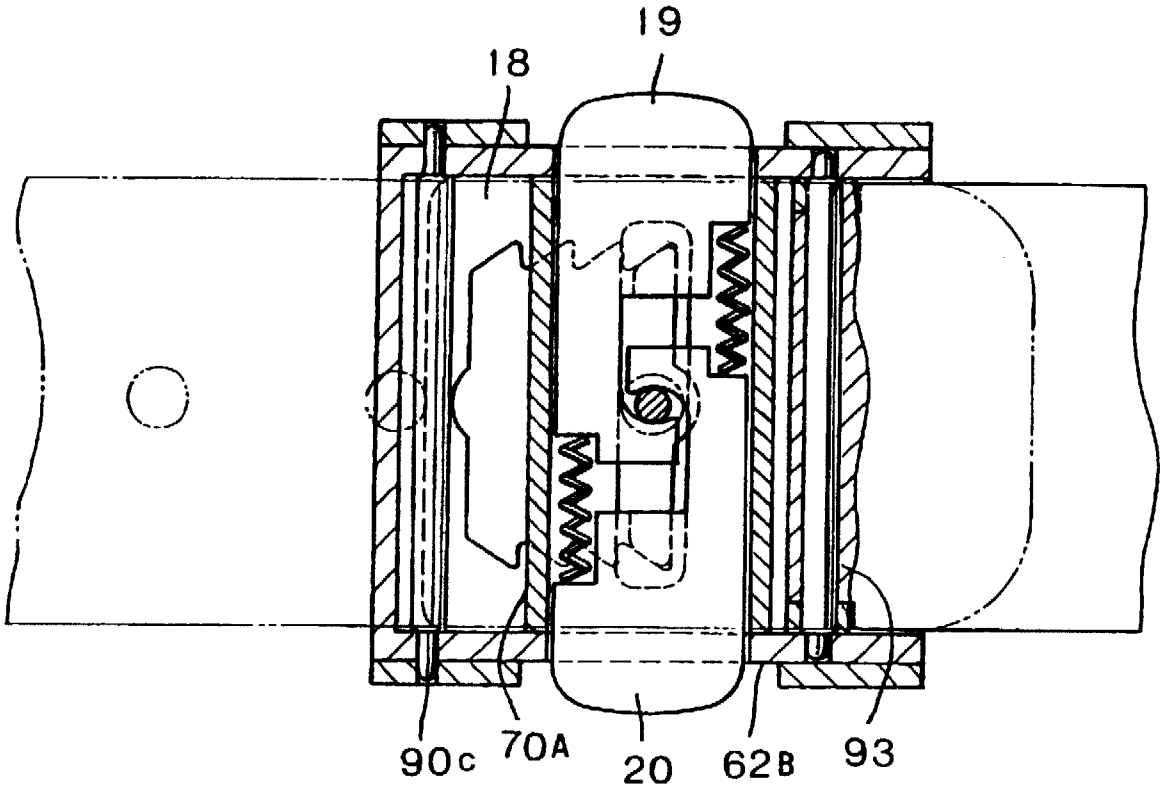
Figure 29:
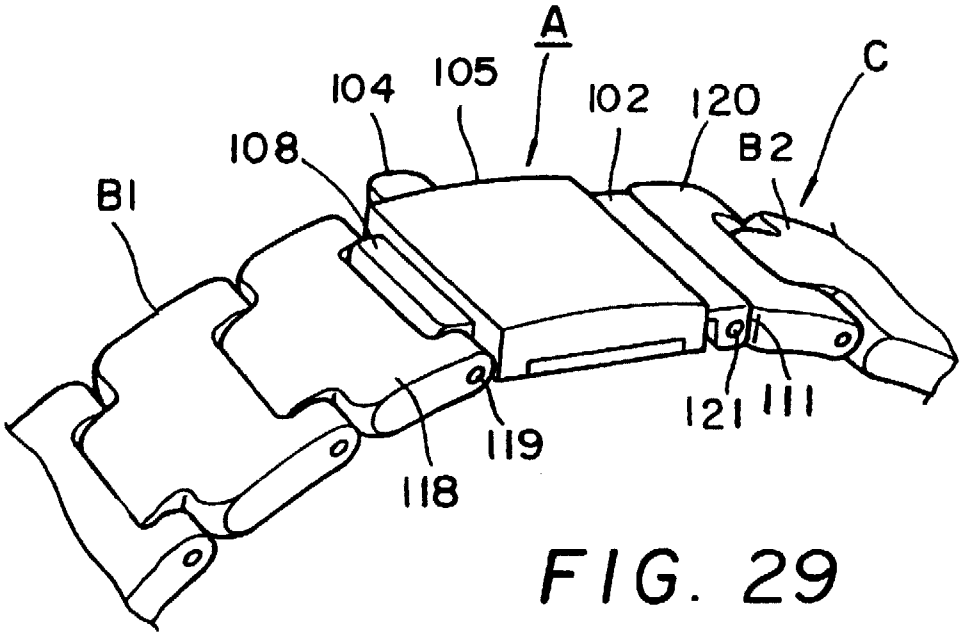
Figure 30:
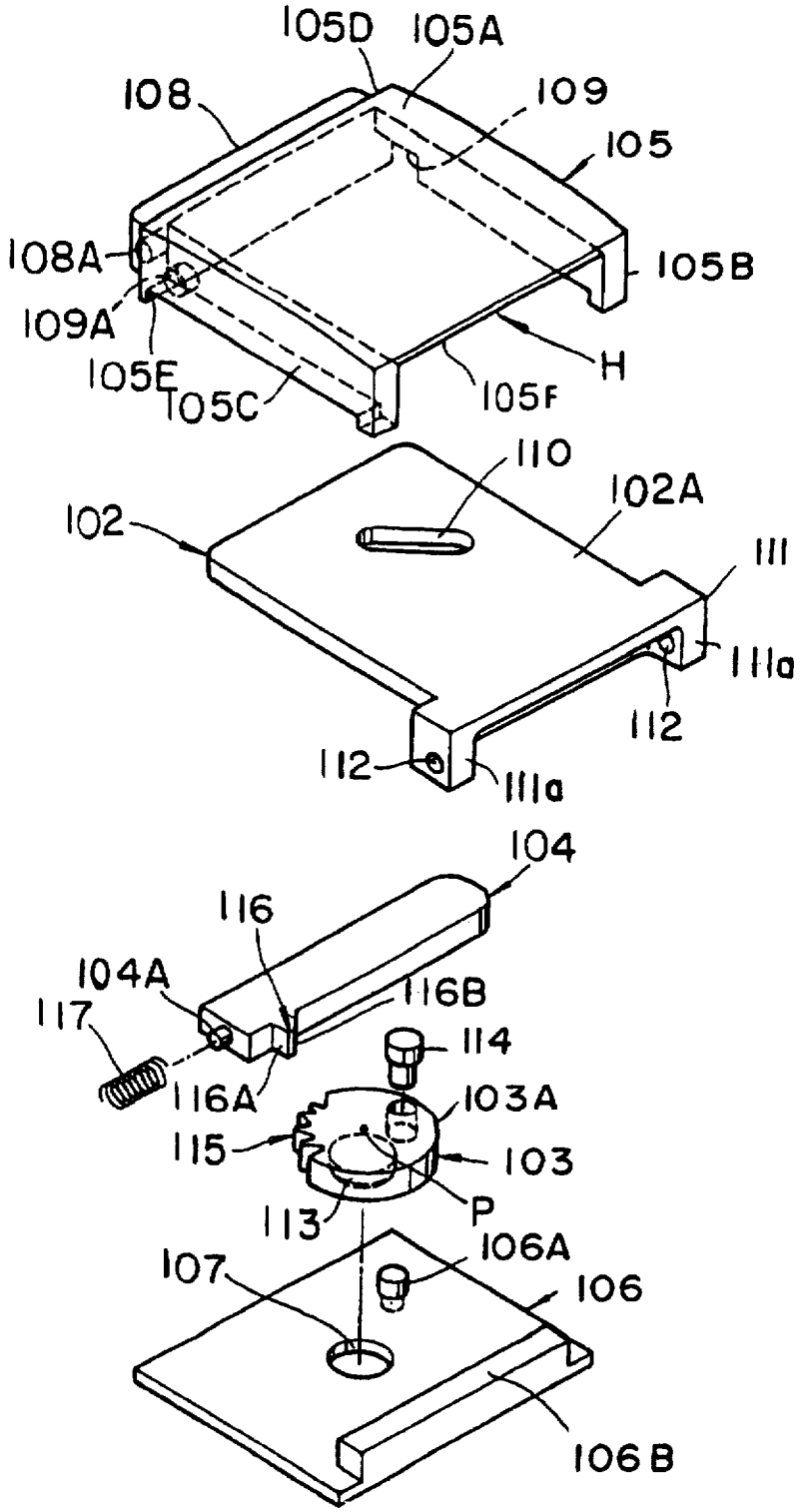
Figure 31A:
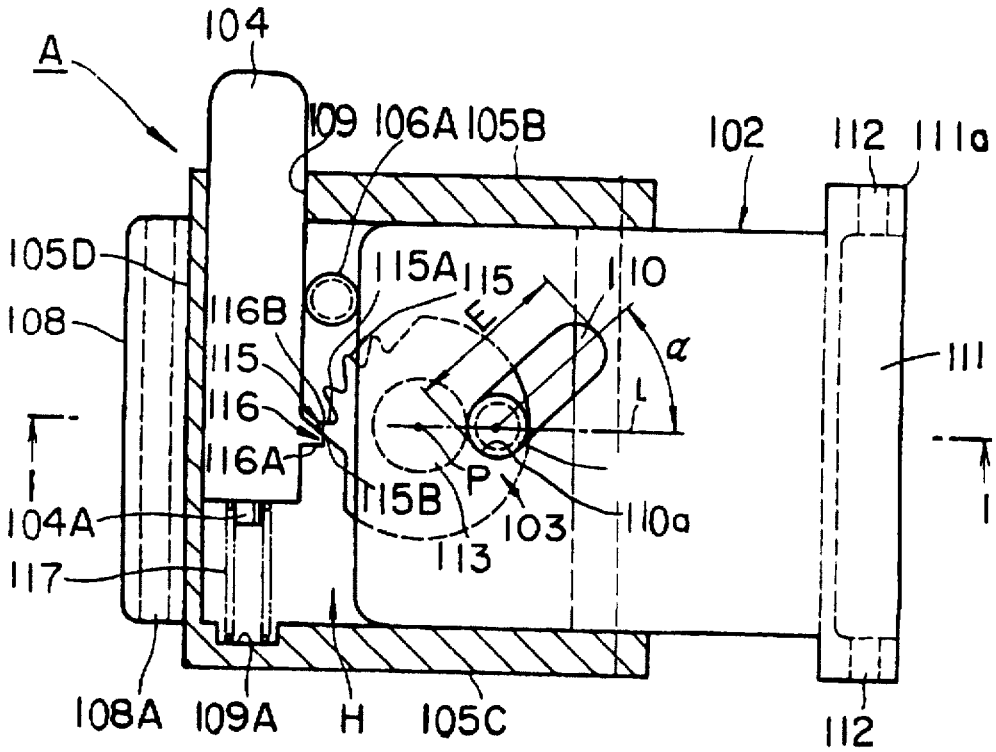
Figure 31B:
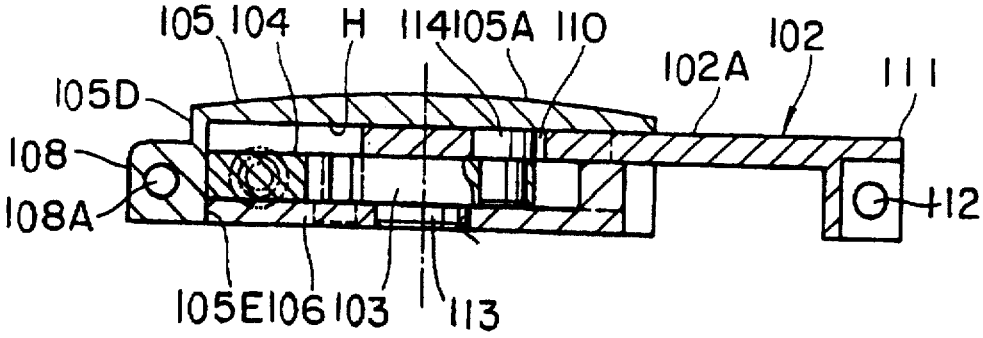

FIG. **5*a*** is a perspective view showing a housing of the buckle;

FIG. **5*b*** is a perspective view showing the housing as viewed from the side under the housing;

FIG. 6 is a perspective view showing a guide housing of the buckle;

FIG. 7 is a perspective view showing a slide plate of the buckle;

FIG. 8 is a perspective view showing a pair of push plates of the buckle;

FIG. 9 is a sectional side view showing a buckle of a second embodiment of the present invention;

FIG. 10 is a sectional plan view showing the buckle of the second embodiment taken along a line X—X of FIG. 9;

FIG. 11 is a perspective view showing a guide housing of the second embodiment;

FIG. 12 is a perspective view showing a pair of push plates of the second embodiment;

FIG. 13 is an exploded perspective view showing a buckle of a third embodiment of the present invention;

FIG. 14 is a schematic plan view showing a modification of the slide plate and the push plates;

FIG. 15 is a schematic plan view showing another modification of the slide plate and the push plates;

FIG. 16 is a schematic plan view showing a further modification of the slide plate and the push plates;

FIG. 17 is an exploded perspective view showing a modification of the buckle of the first embodiment;

FIG. 18 is an exploded perspective view showing another modification of the buckle of the first embodiment;

FIG. 19 is an exploded perspective view showing a further modification of the buckle of the first embodiment;

FIG. 20 is an exploded perspective view showing another example of the watch band buckle to which the adjusting device of the present invention is applied;

FIG. 21 is an exploded perspective view showing a fourth embodiment of the buckle of the present invention;

FIG. 22 is a perspective view showing a fifth embodiment of the present invention;

FIG. 23 is an exploded perspective view of the fifth embodiment;

FIG. 24 is a sectional plan view of an adjusting device;

FIG. 25 is a sectional side view of the adjusting device;

FIG. 26 is a perspective view showing a sixth embodiment of the present invention;

FIG. 27 is a sectional side view of an adjusting device of the embodiment;

FIG. 28 is a sectional plan view of an adjusting device;

FIG. 29 is a perspective view showing a main part of the watch band as the personal adornment band of a seventh embodiment having an adjusting device according to the present invention;

FIG. 30 is an exploded perspective view showing the adjusting device of the seventh embodiment;

FIG. 31*a* is a sectional plan view showing the adjusting device;

FIG. 31*b* is a sectional side view showing the adjusting device taken along a line I—I of FIG. 31*a;*

Figure 32A:
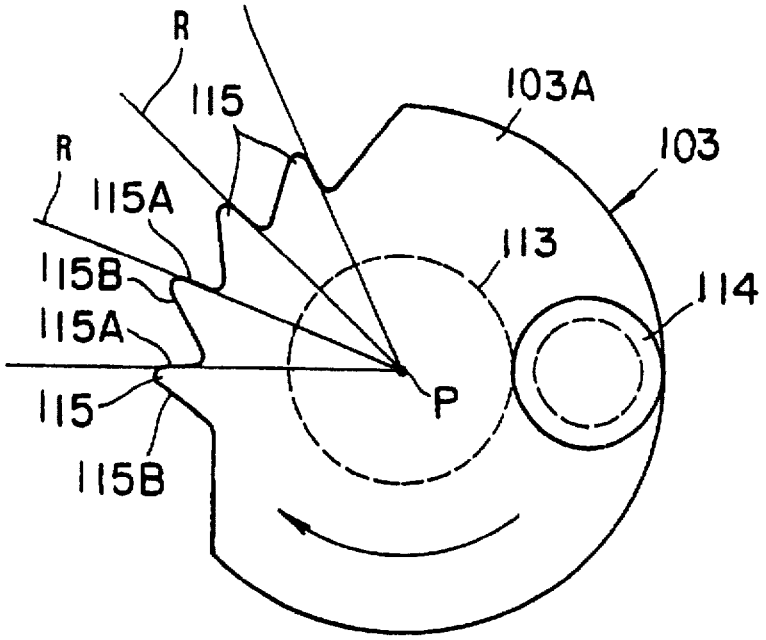
Figure 32B:
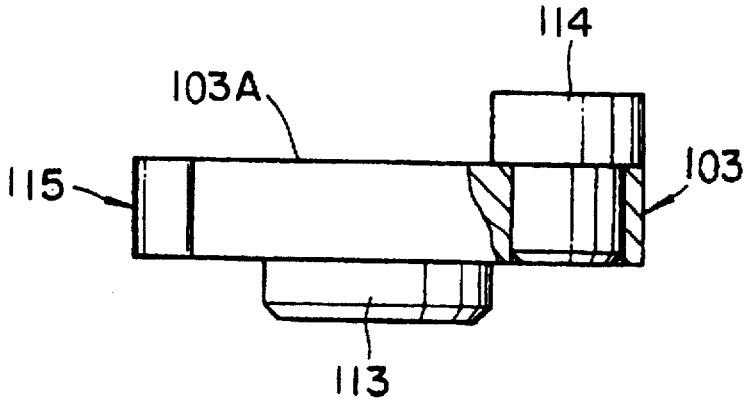
Figure 34:
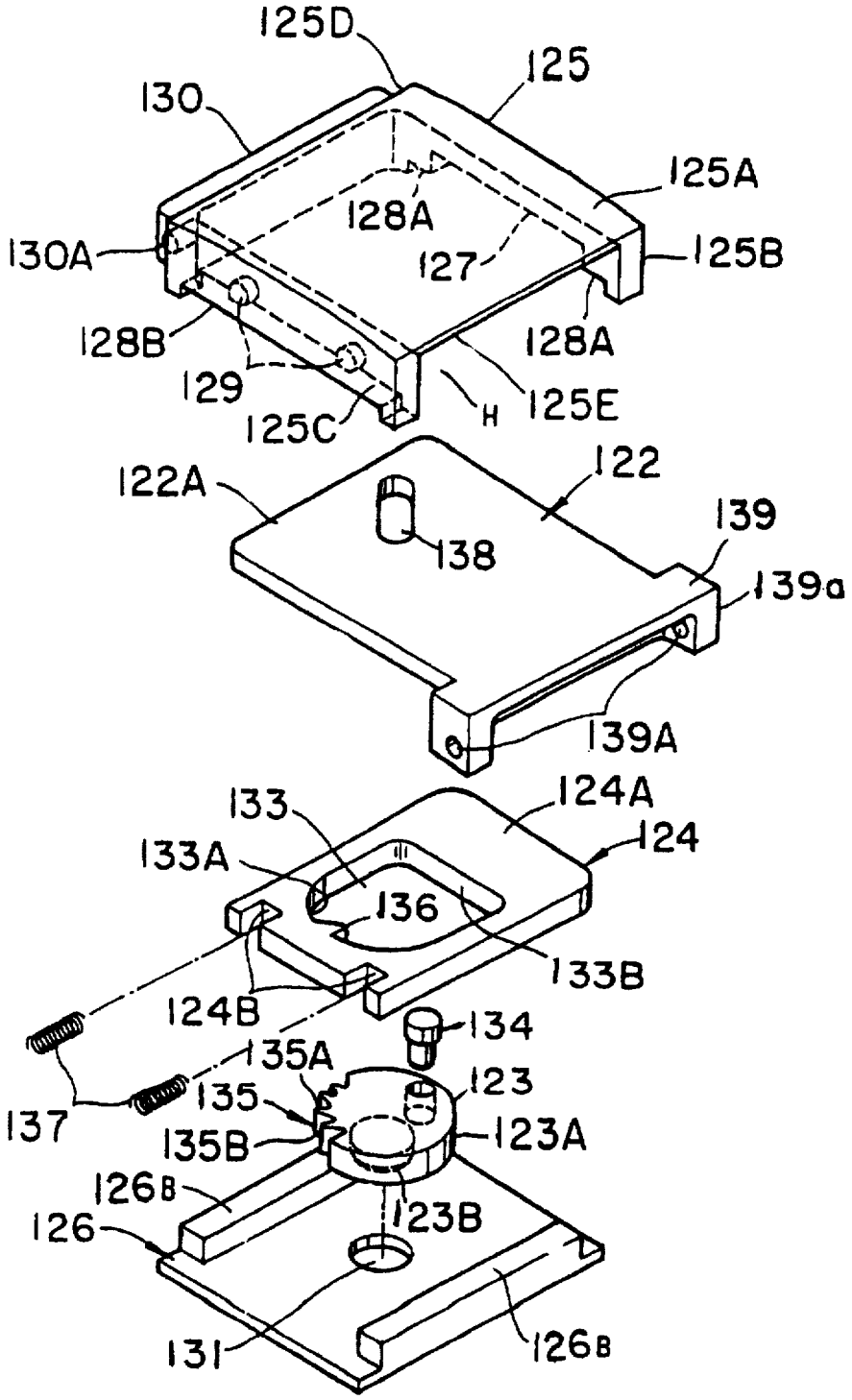
Figure 35A:
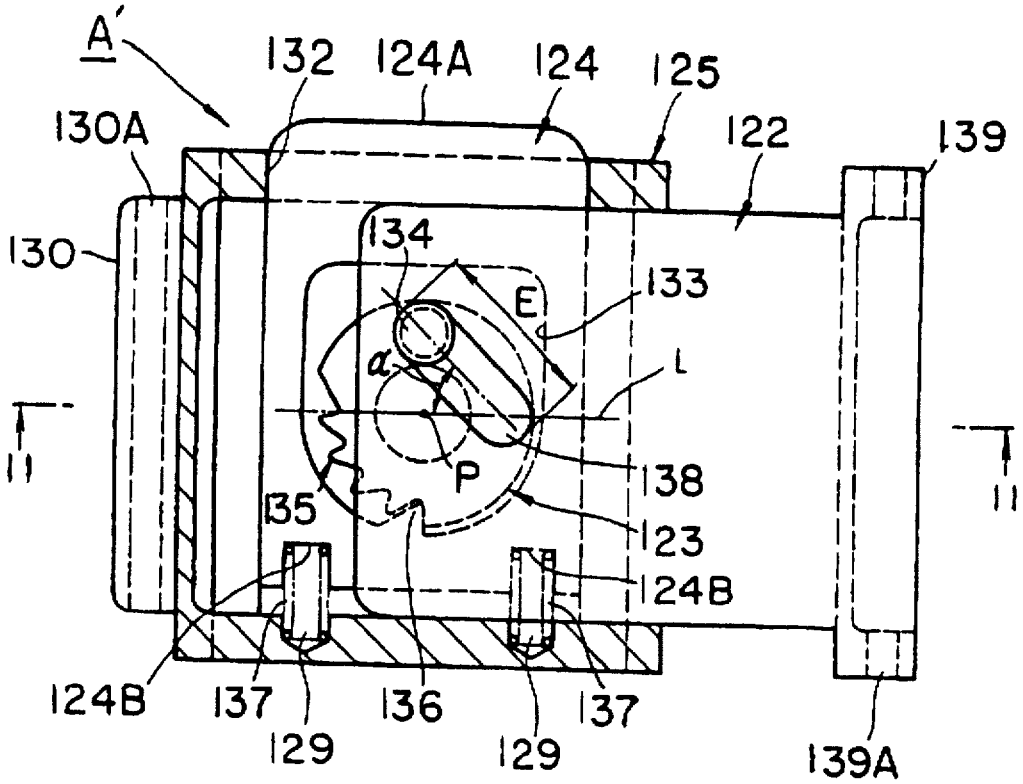
Figure 35B:
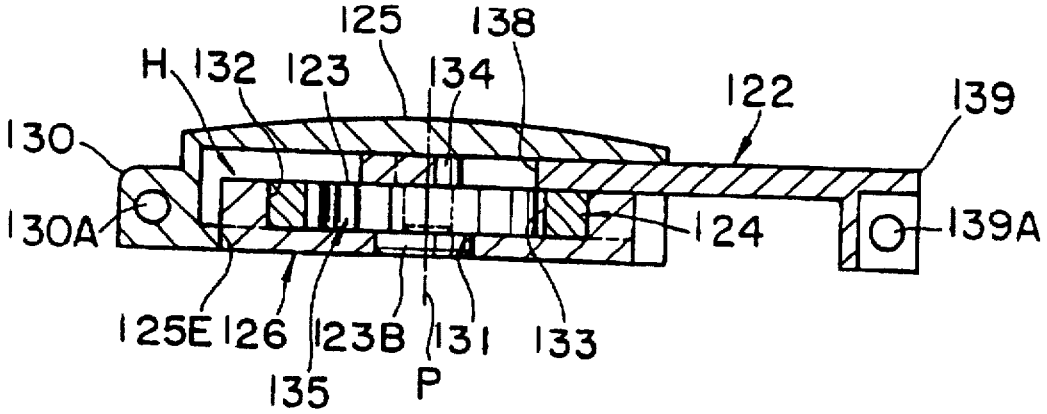

FIG. 32*a* is a plan view showing a rotary plate of the adjusting device;

FIG. 32*b* is a side view showing the rotary plate a part of which is shown in section;

FIGS. 33*a*, 33*b*, 33*c* and 33*d* are schematic diagrams showing adjusting operations of the adjusting device;

FIG. 34 is an exploded perspective view showing an adjusting device of an eighth embodiment of the present invention;

FIG. 35*a* is a sectional plan view showing the adjusting device of the eighth embodiment;

FIG. 35*b* is a sectional side view showing the adjusting device taken along a line II—II of FIG. 35*a;*

Figure 36:
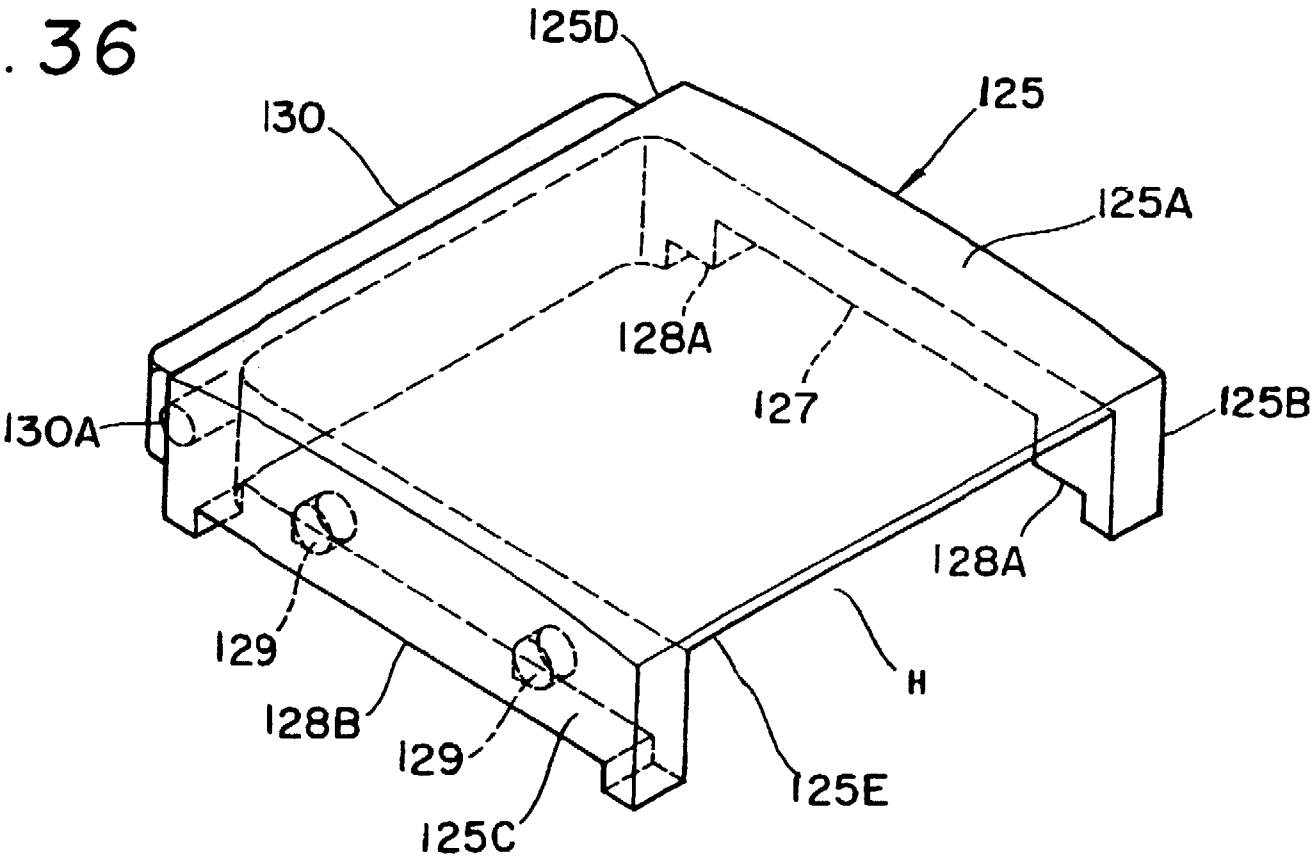
Figure 37:
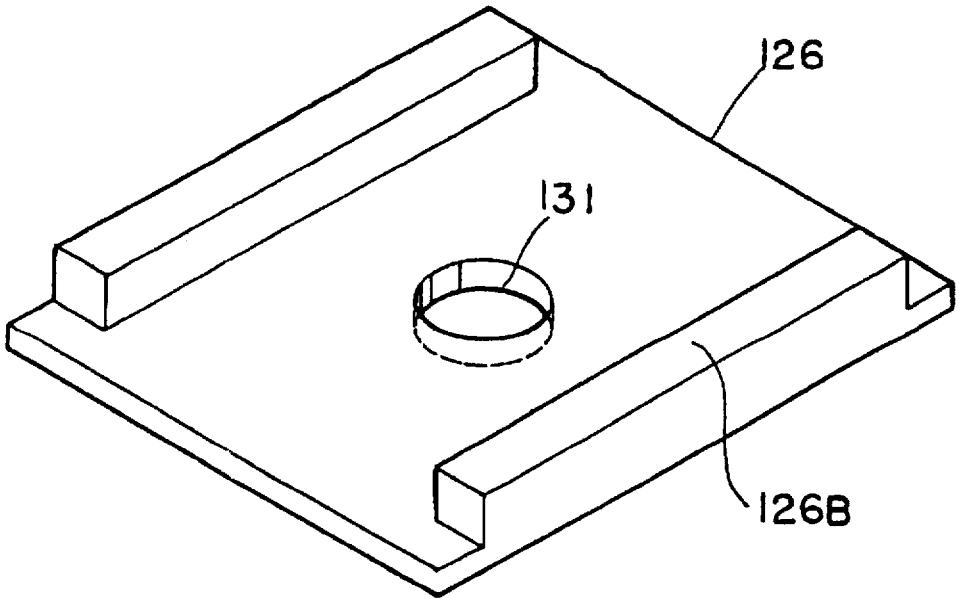
Figure 38:
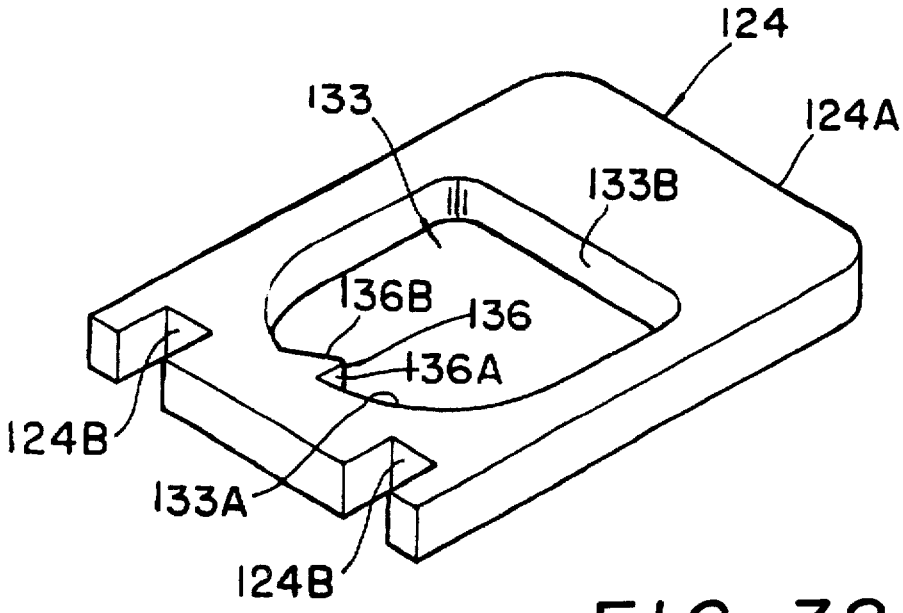
Figure 39A:
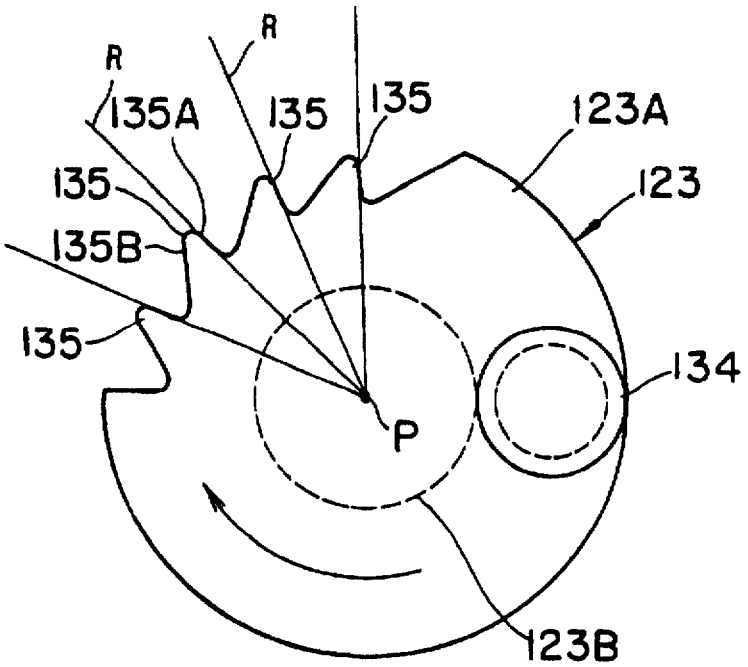
Figure 39B:
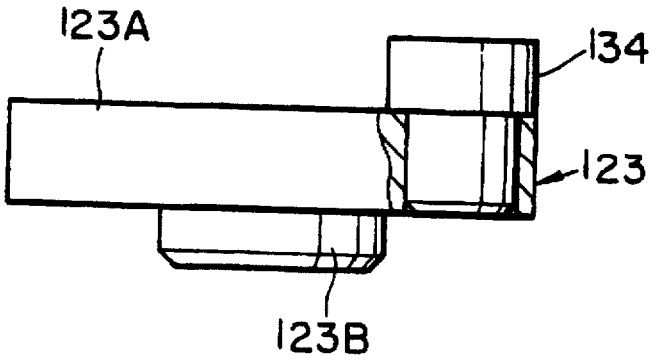
Figure 41:
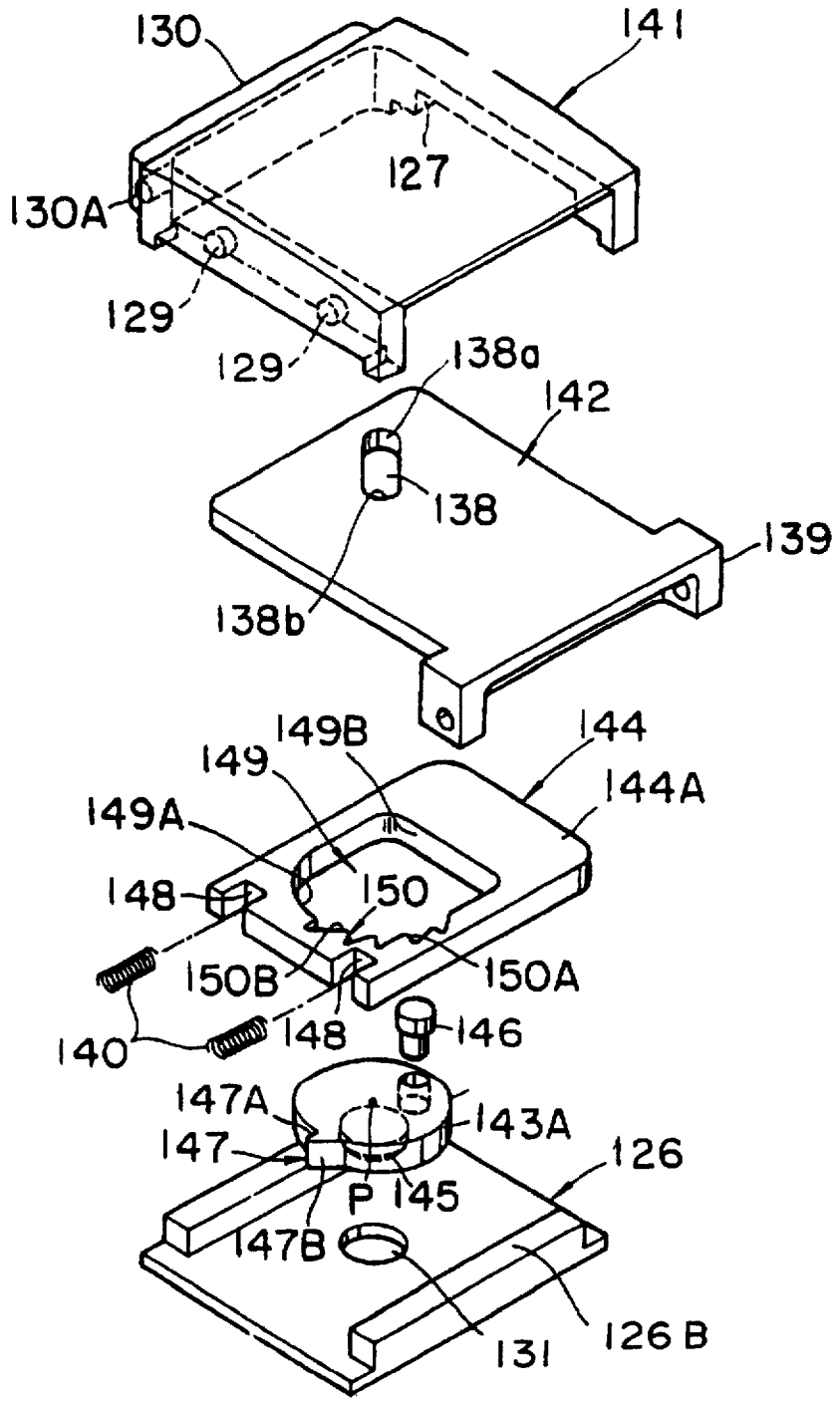
Figure 42A:
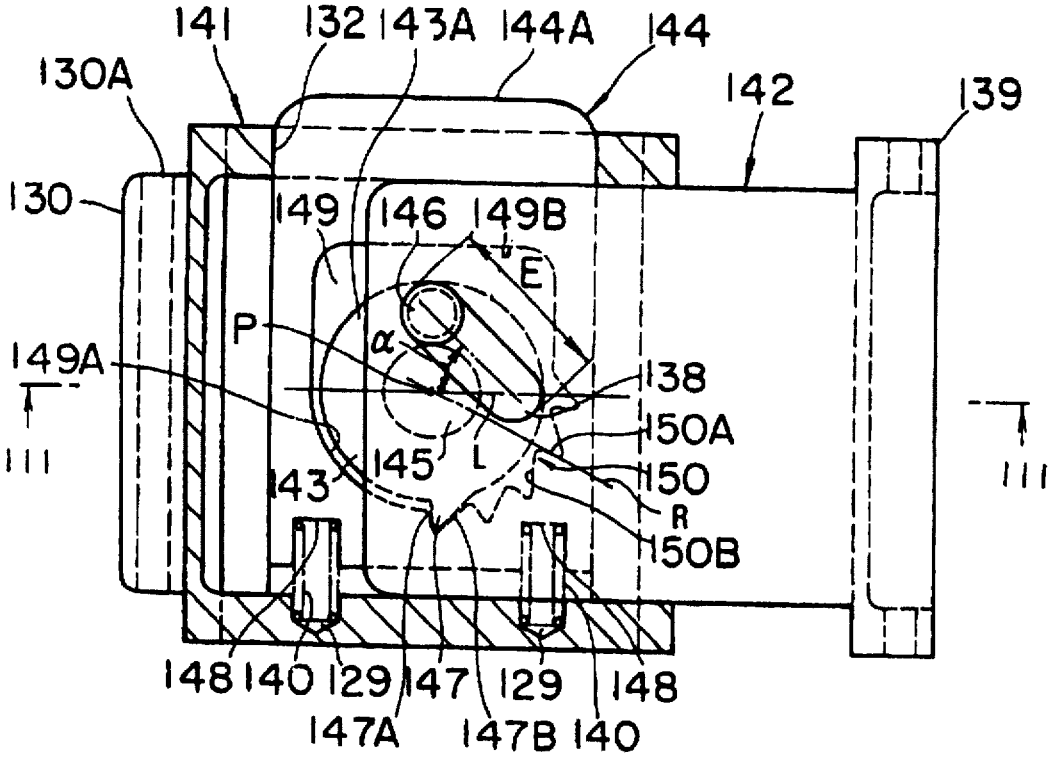
Figure 42B:
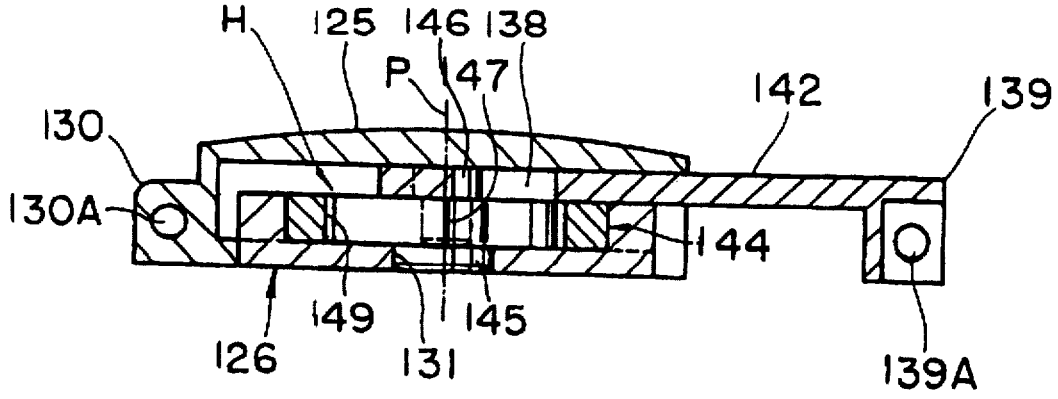

FIG. 36 is a perspective view showing a housing of the adjusting device of the eighth embodiment;

FIG. 37 is a perspective view showing a base plate of the eighth embodiment;

FIG. 38 is a perspective view showing a push plate of the eighth embodiment;

FIG. 39*a* is a plan view showing a rotary plate of the eight embodiment;

FIG. 39*b* is a side view showing the rotary plate a part of which is shown in section;

FIGS. 40*a*, 40*b*, 40*c* and 40*d* are schematic diagrams showing adjusting operations of the embodiment;

FIG. 41 is an exploded perspective view showing an adjusting device of a ninth embodiment of the present invention;

FIG. 42*a* is a sectional plan view of the ninth embodiment;

FIG. 42*b* is a sectional side view of the ninth embodiment taken along a line III—III of FIG. 42*a;*

Figure 44:
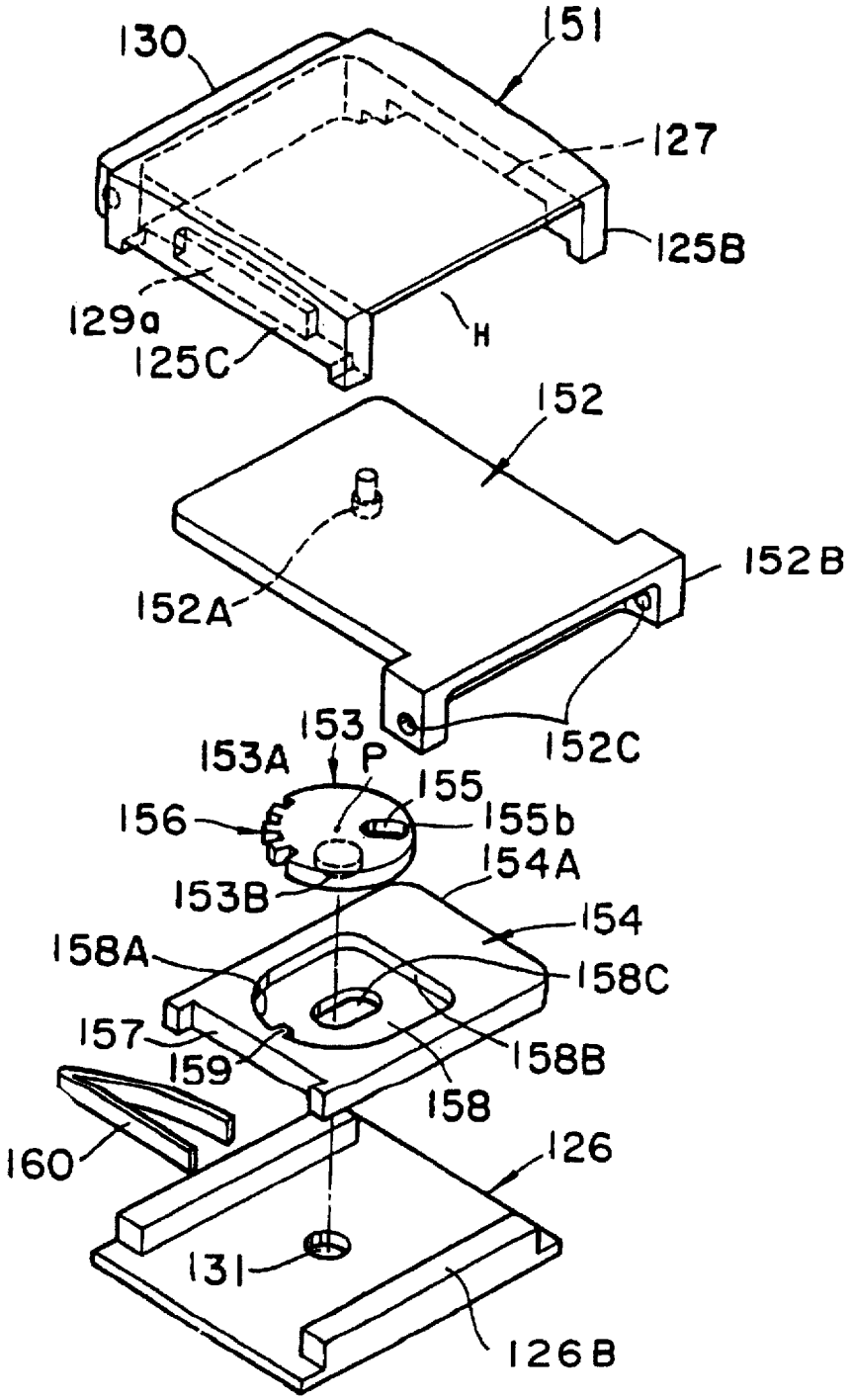
Figure 45A:
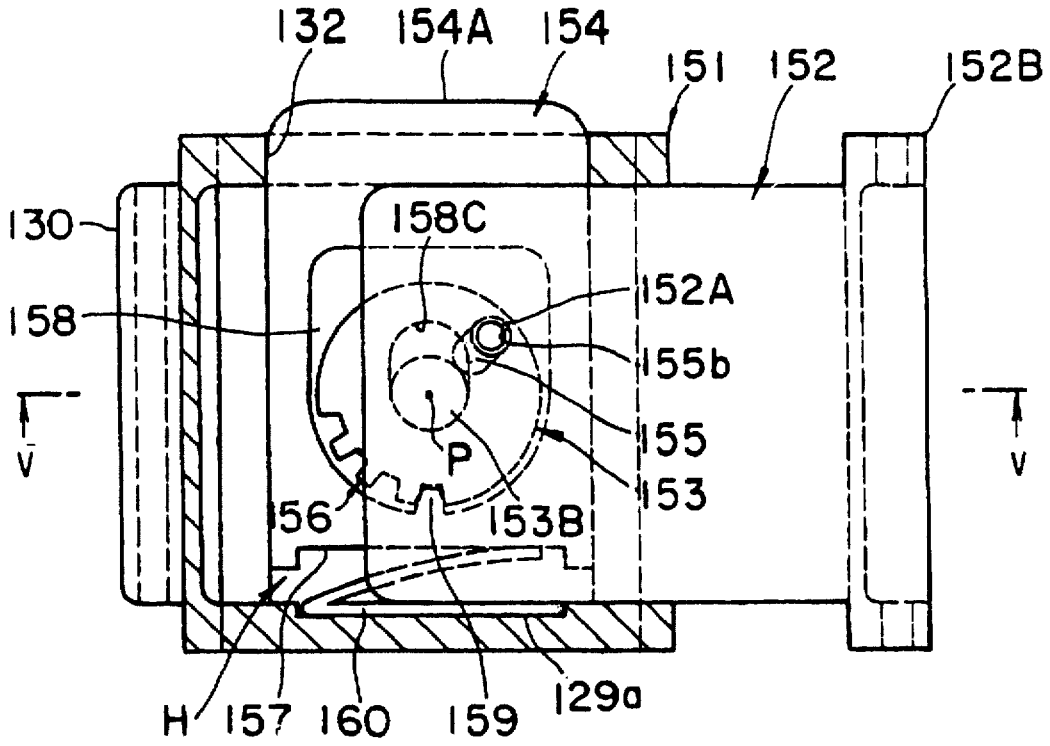
Figure 45B:
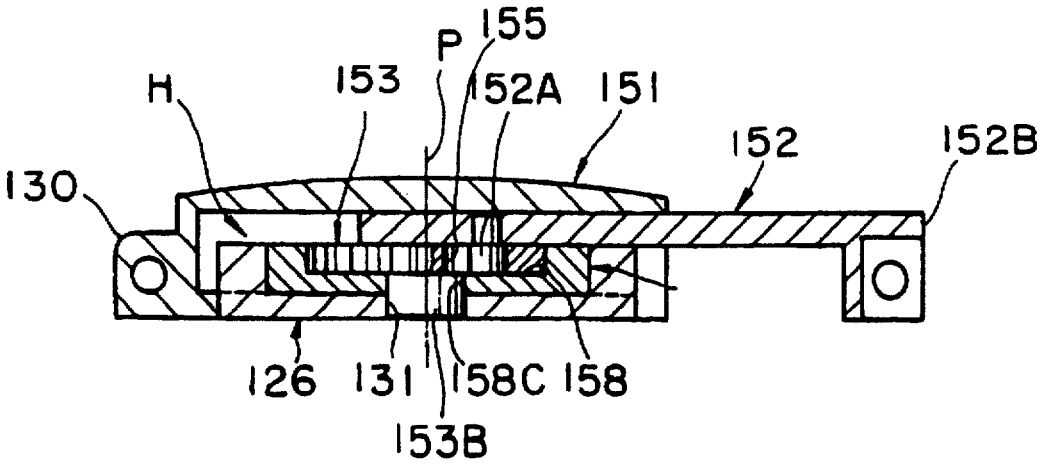

FIGS. 43*a*, 43*b*, 43*c* and 43*d* are schematic diagrams showing adjusting operations of the embodiment;

FIG. 44 is an exploded perspective view showing an adjusting device of a tenth embodiment of the present invention;

FIG. 45*a* is a sectional plan view of the tenth embodiment;

FIG. 45*b* is a sectional side view of the embodiment taken along a line V—V of FIG. 45*a;*

Figure 47:
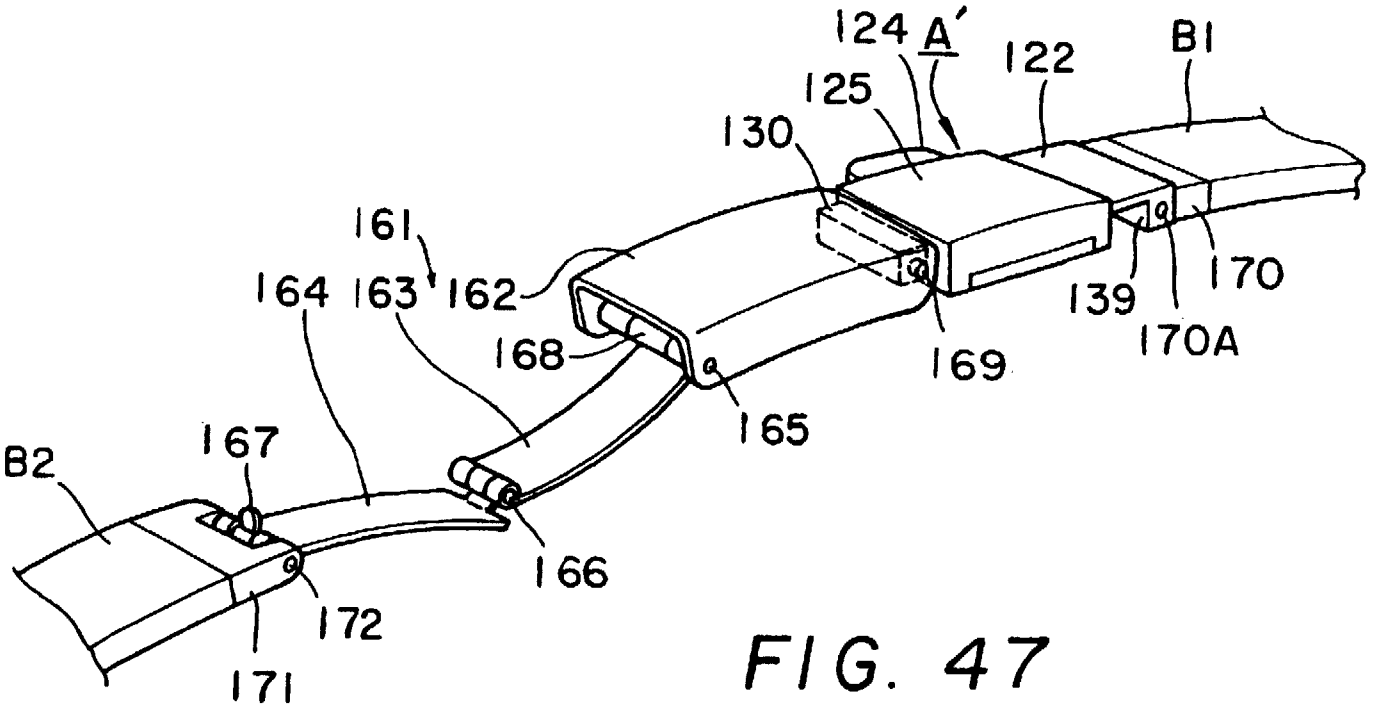
Figure 48:
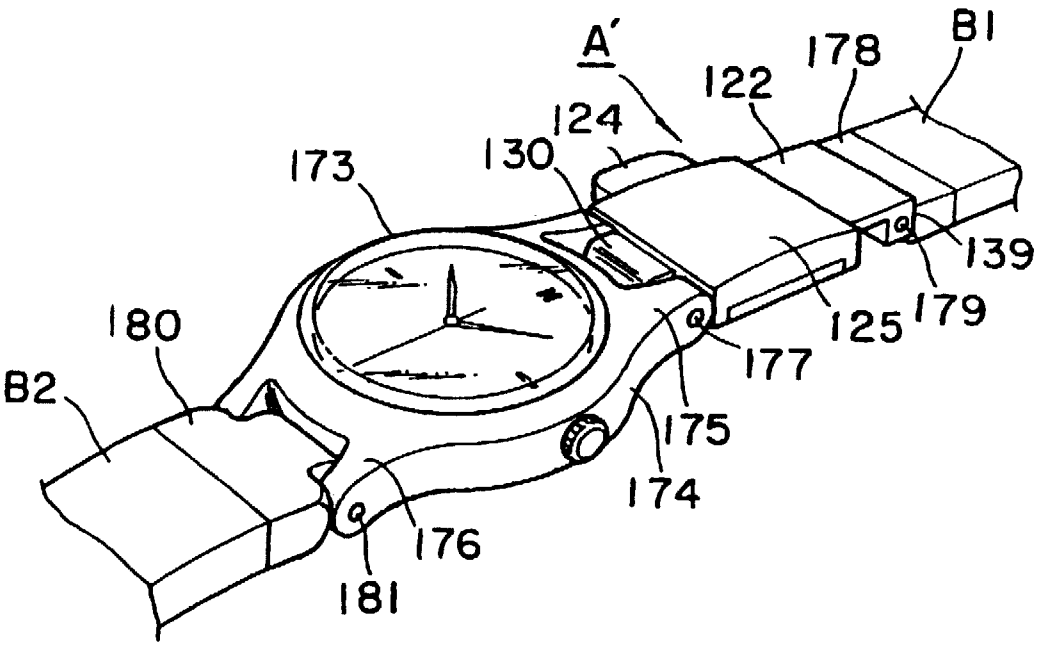
Figure 49:
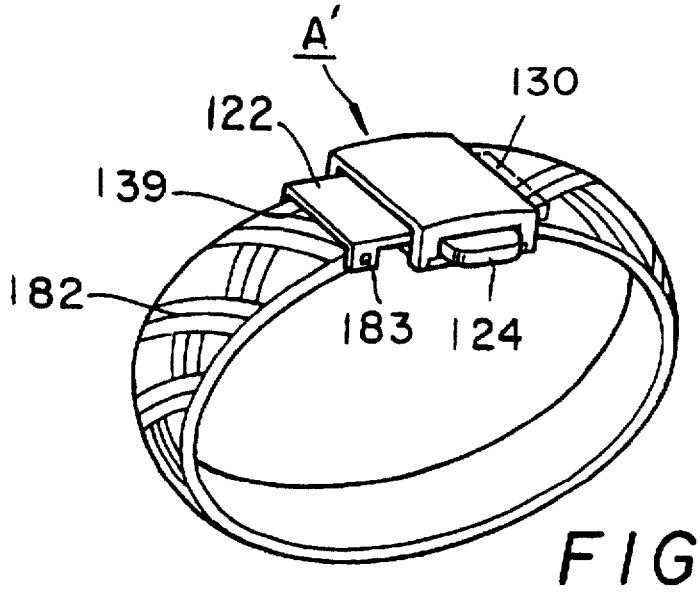
Figure 50:
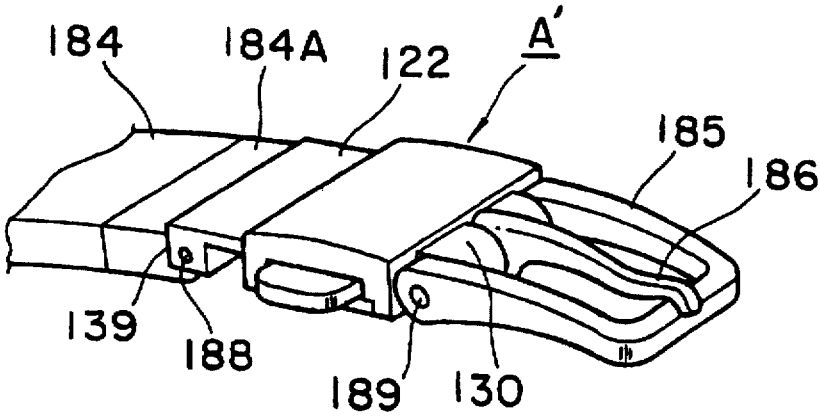
Figure 50:
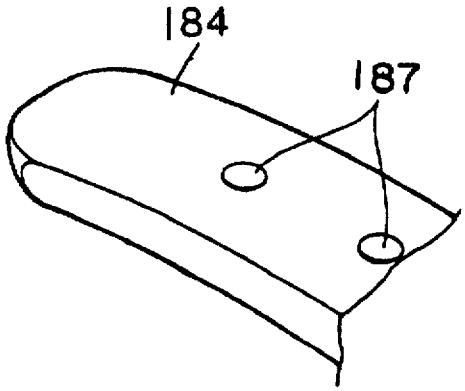
Figure 51:
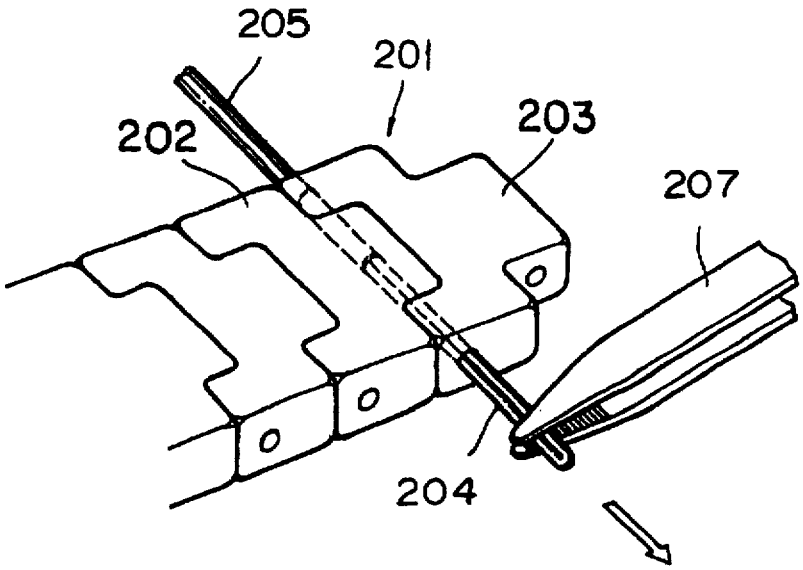
FIG. 51 PRIOR ART
Figure 52:
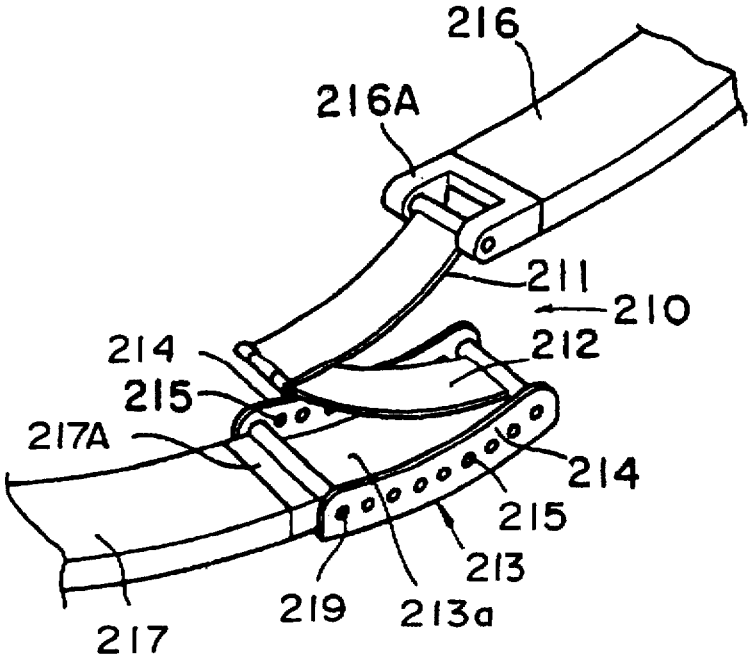
FIG. 52 PRIOR ART

FIGS. 46*a*, 46*b*, 46*c* and 46*d* are schematic diagrams showing adjusting operations of the embodiment;

FIG. 47 is a perspective view showing an example of the personal adornment band having a triple-folded band buckle to which the adjusting device of the present invention is applied;

FIG. 48 is a perspective view showing another example of a watch band to which the adjusting device of the present invention is applied;

FIG. 49 is a perspective view showing a bracelet as a personal adornment band to which the adjusting device of the present invention is applied;

FIG. 50 is a perspective view showing a belt as a personal adornment band to which the adjusting device of the present invention is applied;

FIG. 51 is a perspective view showing a conventional adjusting device of a watch band; and FIG. 52 is a perspective view showing another conventional adjusting device of a band buckle.

BEST MODE FOR EMBODYING THE INVENTION

The embodiments of the present invention will be described hereinafter in detail based on the accompanying drawings.

Figure 1:
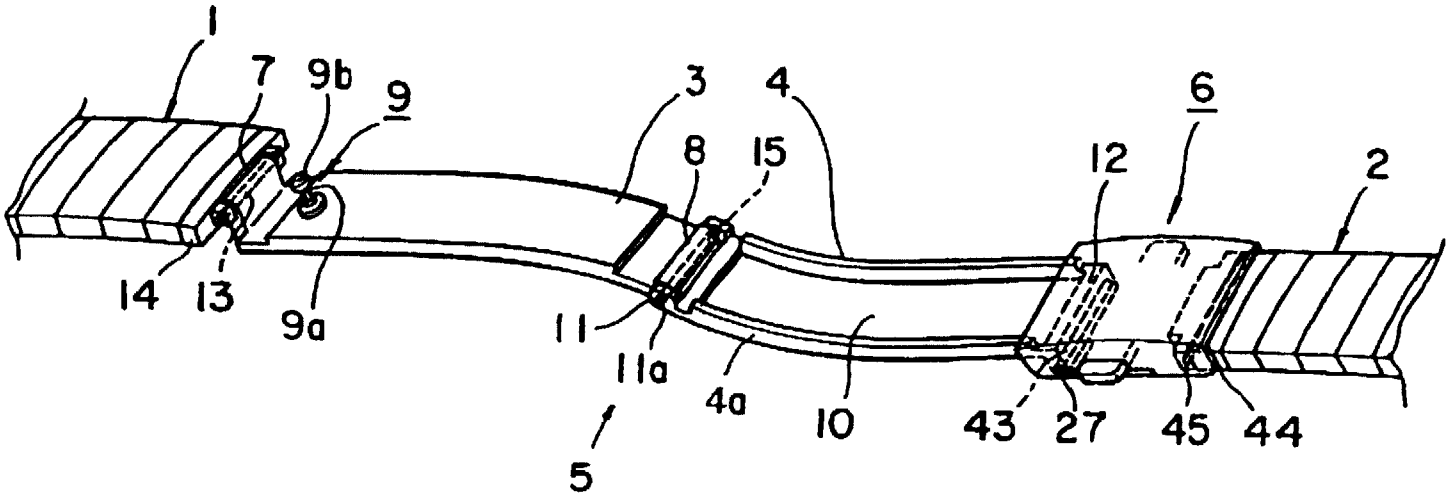
FIG. 1 is a perspective view showing a main part of a structure of a watch band as a personal adornment band having an adjusting device according to the present invention as a first embodiment.

FIG. 1 shows a watch band for a wrist watch having an adjusting device to which the present invention is applied as a first embodiment. The watch band comprises a first band 1 connected to an end of a watch case of a wrist watch (not shown), a second band 2 connected to the other end of the watch case, a folding plate member 5 having an inner plate 3 and an outer plate 4 pivotally connected to the inner plate 3, and an adjustment buckle 6 connected to the second band 2. The adjustment buckle 6 has the adjusting device having an adjusting pitch for adjusting the length of the watch band more finely than an adjusting device provided in the first or second band. The folding plate member 5 and the adjustment buckle 6 compose a folded band buckle as will be understood by the following description.

The inner plate 3 of the folding plate member 5 has cylindrical connecting portions 7 and 8 provided at both ends thereof, and a lock pin 9 securely mounted thereon at a side near the connecting portion 7. The connecting portions 7 and 8 are engaged with connecting pins 13 and 15, respectively. The lock pin 9 has a stem 9*a* and a conical head 9*b*.

The outer plate 4 comprises a rectangular frame 4*a* to form an opening 10 to be engaged with an outer periphery of the inner plate 3. The outer plate 4 has a pair of connecting lugs 11 formed on an end, and a cylindrical connecting portion 12 formed on the other end. Each of the connecting lugs 11 has a hole 11*a*. The connecting portion 12 has a hole for inserting a connecting pin 43, which will be described hereinafter.

The connecting portion 7 of the inner plate 3 is pivotally connected to a connecting link 14 of the first band 1. The connecting portion 8 is pivotally connected to the connecting lugs 11 of the outer plate 4 through the connecting pin 15. The outer plate 4 is connected to the buckle 6 through the connecting portion 12.

Figure 2:
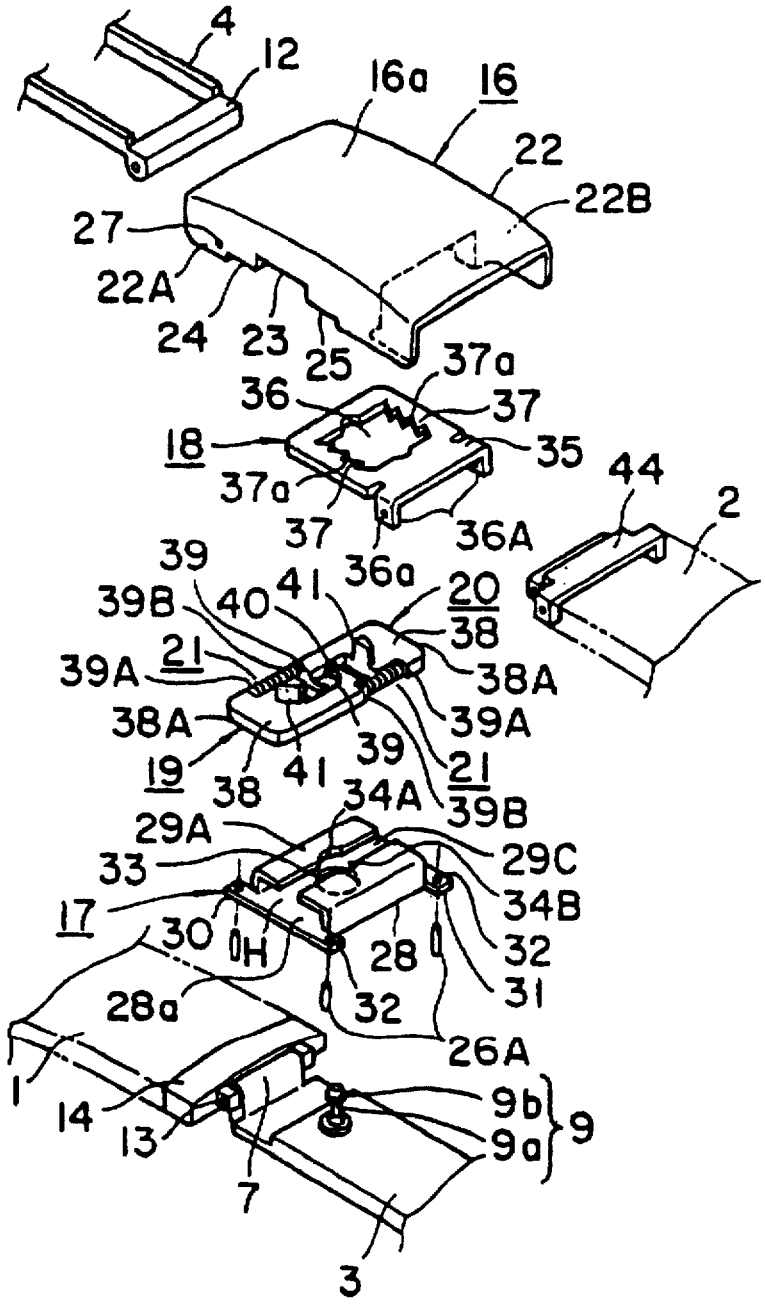
FIG. 2 is an exploded perspective view showing a buckle of the watch band which has the adjusting device.

Referring to FIG. 2, the adjustment buckle 6 comprises a housing 16, a guide housing 17 disposed in the housing 16, a slide plate 18 slidably mounted on the guide housing 17, a pair of push plates 19 and 20 slidably mounted in the guide housing 17, and a pair of coil springs 21 provided between the push plates 19, 20.

Figure 5A:
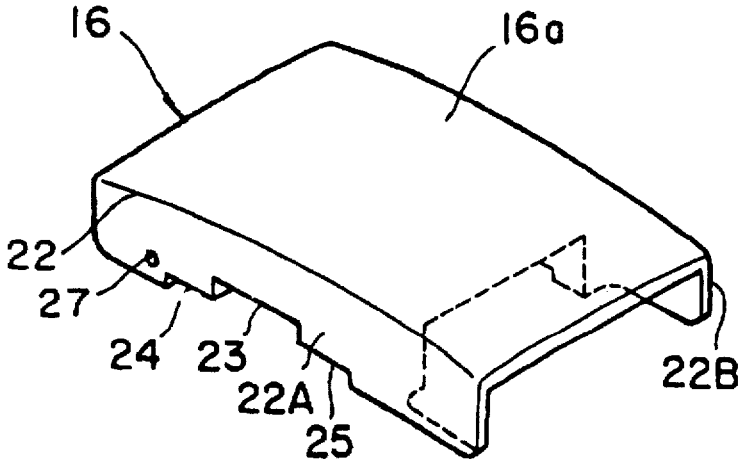
Figure 5B:
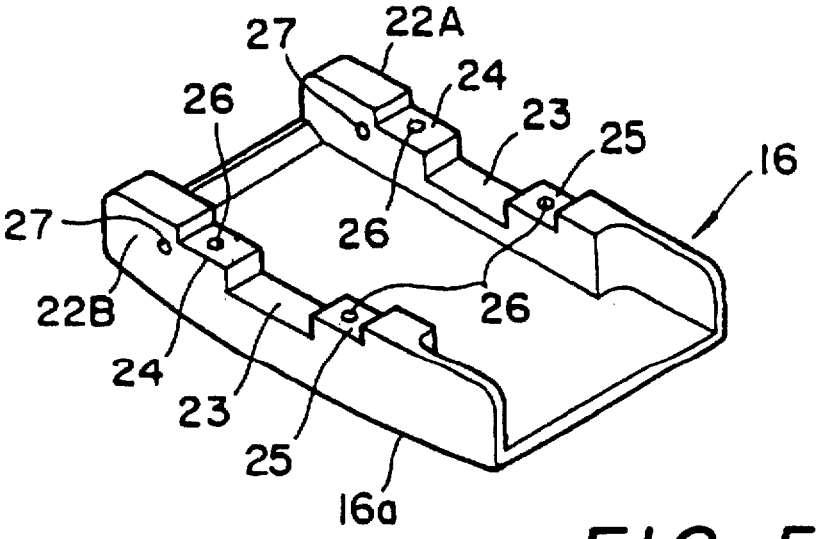

Referring to FIGS. 5*a* and 5*b*, the housing 16 has a body 22 made by casting, forging or machining. The housing 16 comprises a top plate 16*a* having a curved upper surface, and a pair of side plates 22A and 22B formed on the opposite sides in the lateral direction with respect to the longitudinal direction of the band. Each of the side plates 22A and 22B has a notch 23 formed at a central portion thereof, a pair of shoulder portions 24 and 25 formed on the opposite sides of the notch 23, and a lateral hole 27 at an end. Each shoulder portion has a vertical blind hole 26.

Referring to FIG. 6, the guide housing 17 is formed by cutting and bending a metal plate 28. The guide housing 17 comprises a base portion 28*a*, a pair of upper portions 29A and 29B formed by bending opposite sides of the base portion 28*a* in the longitudinal direction of the band and arranged in parallel with the base portion to form a gap 29C there-between. Thus, a housing space H is formed in the guide housing, oriented in the lateral direction. A pair of connecting portions 30 and 31 are projected from the opposite sides of the base portion 28*a* in the lateral direction of the band. Each connecting portion has a pair of holes 32 at both end portions. The base portion 28*a* has an opening 33 having a circular shape formed in a central portion thereof. Each of the upper portions 29A and 29B has a notch 34A (34B) having an arc shape corresponding to the opening 33.

Referring to FIG. 7, the slide plate 18 comprises a flat body 35 having a rectangular opening 36, and a connecting portion 35A. A pair of ratchets 37 are symmetrically formed on opposite peripheries of the opening 36, arranged in the longitudinal direction of the band so as to provide a length adjusting mechanism of the band. Each tooth of the ratchet 37 comprises an engaging surface 37*a* perpendicular to the longitudinal line of the band, and a sliding surface 37*b*. The engaging surface 37*a* is formed to prevent relative movement of the housing 16 and the slide plate 18 in the band expansion direction as described hereinafter. The connecting portion 35A has a pair of connecting lugs 36A each of which has a hole 36*a*.

Referring to FIG. 8, each of the push plates 19, 20 comprises a body 38 which is the same as the other push plate in configuration. The body 38 has a manipulating lug 38A, an inner notch 39 formed opposite to the manipulating lug, and an engaging hook 40 having a semi-circular inside wall and inwardly projected from the end of the inner notch 39. An engaging projection 41 having an engaging portion 41*a* and a slant 41*b* is upwardly projected from the body 38 at the outer side periphery of the notch 39. A pair of outer notches 39A and 39B are formed on both sides of the push plate so as to confront each other.

The push plates 19 and 20 are disposed in a point symmetry such that the engaging hooks 40 are opposed to each other and the outer notch 39A of one of the push plates corresponds to the outer notch 39B of the other push plate. However, the engaging projections 41 are symmetrically provided on the push plates.

To assemble the buckle 6, the push plates 19 and 20 are disposed in point symmetry. A pair of coil springs 21 are disposed between the outer notches 39A and 39B of the opposite push plates 19 and 20, respectively so as to urge the push plates in the opposite directions (FIG. 2). The unit of the push plates is inserted into the housing space H from a side of the guide housing 17, while the engaging projections 41 of the push plates are inserted into the gap 29C between the upper portions 29A and 29B to be projected from the guide housing. The engaging hooks 40 are disposed corresponding to the opening 33. The manipulating lugs 38A are projected from the upper portions 29A and 29B.

Figure 4:
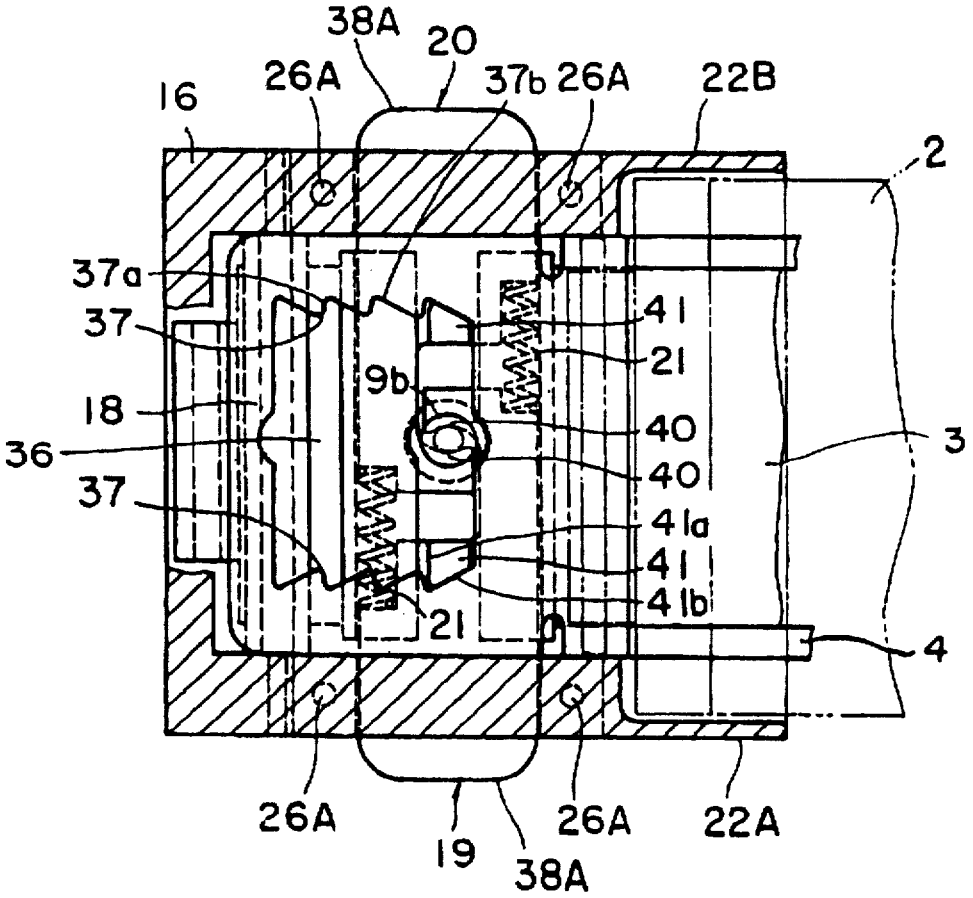
FIG. 4 is a sectional plan view showing the buckle taken along a line IV—IV of FIG. 3.

The flat body 35 of the slide plate 18 is mounted on the upper portions 29A and 29B of the guide housing 17. The engaging projections 41 projected from the upper portions 29A and 29B are inserted into the opening 36 and engaged with the corresponding tooth of the ratchets 37 of the slide plate 18. The engaging portion 41*a* of the engaging projection 41 is engaged with the engaging surface 37*a* of the ratchet 37 and the slant 41*b* is engaged with the sliding surface 37*b* (FIG. 4).

Therefore, the push plates 19, 20 are prevented from removing from the guide housing 17 by the slide plate 18, and the slide plate 18 is prevented from removing from the guide housing 17 by the push plates 19, 20.

The assembly of the guide housing 17 and the slide plate 18 is disposed between the side plates 22A and 22B of the housing 16, and the connecting portions 30 and 31 of the guide housing 17 are engaged with the shoulder portions 24 and 25 of the side plates 22A and 22B, respectively. In this state, the housing space H of the guide housing 17 coincides with the space formed by each of the notches 23 of the side plates so that manipulating lugs 38A of the push plates 19 and 20 are projected from the housing 16 through the notches 23.

Each of the side plates 22A and 22B is formed to have a sufficient height to form a space 42 (FIG. 3) so that the slide plate 18 can be slid in the space.

Pins 26A are inserted into the holes 32 of the connecting portions 30, 31, and further inserted in the holes 26 of the shoulder portions 24 and 25 by force fitting, and the guide housing 17 is secured to the housing 16 with pins 26A by staking of the head of each pin 26A.

In place of staking, the connecting portion is secured to the side plate by welding, brazing or screwing.

Figure 3:
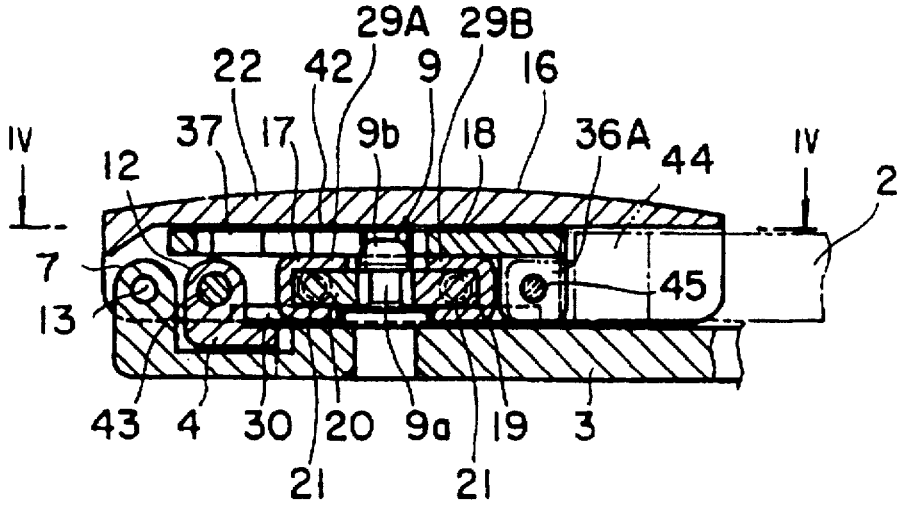
FIG. 3 is a sectional side view showing the buckle.

The holes 27 formed on the side plates 22A, 22B of the housing 16 are connected to the connecting portion 12 of the outer plate 4 by the connecting pin 43. The connecting lugs 36A of the connecting portion 35A of the slide plate 18 is connected to a connecting link 44 of the second band 2 (FIG. 2) with a connecting pin 45 (FIGS. 1, 3). Thus, the buckle 6 is pivotally connected to the outer plate 4 and the second band 2.

The use of the buckle 6 will be described with reference to FIG. 1 where the inner plate 3 and the outer plate 4 are stretched, so that the ring of the watch band is expanded. The expanded watch band is applied on a wrist of the user.

The outer plate 4 is rotated about the pin 15 in the counterclockwise direction, and overlaid on the inner plate 3 so that the inner plate 3 engages with the opening 10 of the frame 4*a*. The buckle 6 is rotated about the pin 43 in the clockwise direction toward the inner plate 3. The lock pin 9 of the inner plate 3 is inserted into the opening 33 of the base portion 28*a* of the guide housing 17. The conical head 9*b* of the lock pin 9 engages with lower edges of the engaging hooks 40 of the respective push plates 19, 20 to outwardly push the engaging hooks against the elastic forces of the coil springs 21. When the conical head 9*b* passes the engaging hooks, the push plates 19, 20 are returned by the springs 21 and the engaging hooks 40 engage with the stem 9*a* of the lock pin (FIG. 3). Thus, the buckle 6 is locked to the inner plate 3, interposing the outer plate 4. Accordingly, the first and second bands 1 and 2 are connected through the buckle 6, so that the watch band is put on the wrist. It will be understood from the foregoing that the inner plate 3, the outer plate 4 and the adjustment buckle 6 compose a triple-folded band buckle.

In order to disengage the buckle, the manipulating lugs 38A of the push plates 19, 20 are pushed by fingers at the same time so that the engaging hooks 40 are opened to be disengaged from the lock pin 9. The buckle 6 is raised, maintaining of gripping of the push plates. Thus, the buckle 6 and the outer plate 4 are disengaged from the inner plate 3, so that the watch band is expanded.

The method for finely adjusting the length of the band will be described.

As aforementioned, the slide plate 18 is employed with the ratchets 37 engaged with the engaging projections 41 of the push plates 19, 20, and the engaging surfaces 37*a* thereof are formed so as to prevent the relative movement of the housing 16 and the slide plate 18 in the band expansion direction as shown in FIG. 4. In FIG. 4, the slide plate 18 connected to the second band 2 is disposed in the innermost position of the buckle 6. Namely, the watch band is in a mostly reduced length condition. The pitch of the ratchet 37 is about 1.3 mm and the length of the band can be adjusted within 5 mm.

In order to increase the length of the band by the fine adjustment, the manipulating lugs 38A of the push plates 19, 20 are inwardly pushed at the same time to disengage each of the engaging projections 41 from the engaged tooth of the ratchet 37. In this state, the second band 2 is pulled out to a desired position, keeping the pushing of the push plates. Then, the push plates are released so that each engaging projection 41 is engaged with a corresponding tooth of the ratchet 37. Thus, the length of the band is elongated.

In order to reduce the length of the band, the second band 2 connected to the slide plate 18 is pushed to the housing 16. In the slide plate 18, the sliding surface 37*b* of each ratchet 37 is slid on the slant 41*b* of the engaging projection 41 one by one. Thus, the second band 2 can be moved in the direction toward the first band 1. When the second band 2 is stopped at a desired position, the length of the band is shortened.

FIGS. 9 to 12 show a second embodiment of the buckle. Structures which are the same as the first embodiment are identified with the same reference numerals as FIGS. 1 to 5, and the descriptions thereof are omitted.

An adjustment buckle 6A of the second embodiment comprises the housing 16, a guide housing 47, a slide plate 18A, a pair of push plates 19A and 20A, and a pair of coil springs 21'.

Referring to FIG. 10, the slide plate 18A has a pair of series of teeth 57 formed by arc-shaped recesses symmetrically formed on the opposite peripheries of the opening 36.

Referring to FIG. 11, the guide housing 47 is formed by cutting and bending a metal plate 52. The guide housing 47 comprises a base portion 52*a*, a pair of side plates 53A and 53B formed by bending opposite sides of the base portion 52*a*, oriented in the lateral direction of the band, and a pair of connecting portions 53 and 54 having holes 55. An opening 56 is formed in the base portion 52*a*.

Referring to FIG. 12, each of the push plates 19A and 20A has a cylindrical engaging projection 48 to be engaged with the arc-shaped recesses of the teeth 57 of the slide plate 18A, and a pin 49 projected from the outer notch 39B to be engaged with the coil spring 21'.

To assemble the buckle 6A, the coil spring 21' is engaged with the pin 49 formed on the notch 39B of each push plate. The push plates 19A and 20A with the springs 21' are mounted on the base portion 52*a* of the guide housing 47 in point symmetry.

Since the upper side of the guide housing 47 is opened, the springs 21' may disengage from the push plate during the operation. In order to prevent the disengagement of the spring, the pin 49 is provided on the outer notch 39B of each push plate to be engaged with the spring 21'. Thus, the springs 21' are securely held between the push plates.

The slide plate 18A is mounted on the guide housing 47, and the cylindrical engaging projections 48 of the push plates are engaged with corresponding teeth 57 of the slide plate. Since the engaging projections 48 of push plates 19A, 20A are resiliently engaged with the teeth 57 by the springs 21', the push plates and the slide plate are prevented from removing from each other.

The unit of the guide housing 47 and the slide plate 18A is disposed in the housing 16 and secured thereto in the same manner as the first embodiment, by force fitting pins passing through the holes 55 of the guide housing 47.

In the embodiment, since the upper portion of the guide housing 47 is opened, the thickness of the buckle 6A is reduced.

The buckle 6A is connected to the bands 1 and 2 in the same manner as the first embodiment and the engaging and disengaging operations of the buckle are performed in the same manners as the first embodiment.

The method for finely adjusting the length of the band will be described. In the embodiment, the length of the band is adjusted without pushing the push plates. The engaging projection 48 of the push plate has the cylindrical shape and each tooth 57 of the slide plate 18A has the arc shape. If the second band 2 is forcibly pushed or pulled, the opposite teeth 57 slide on the cylindrical projections 48 one by one.

Needless to say, the length of the band can be adjusted by pushing the push plates 19A, 20A. Since the pushing operation of the push plates is the same as the previous embodiment, the detailed description thereof is omitted.

Referring to FIG. 13 showing a third embodiment, an adjustment buckle 6' comprises a housing 77, a guide housing 70, slide plate 18, push plates 19 and 20, and coil springs 21. The same parts as the first embodiment are identified with the same reference numerals as FIGS. 1 and 2 and the detailed descriptions thereof are omitted.

The housing 77 has a body 66 made by plate work, and comprises a top plate 66*a* having a curved upper surface and a pair of side plates 67A and 67B. The side plates 67A and 67B have a pair of rectangular openings 68A and 68B, and a pair of holes 69.

The guide housing 70 is formed by bending a metal plate 71 and comprises a base portion 71*a*, a pair of upper portions 72A and 72B formed by bending opposite sides of the base portion 71*a* and arranged in parallel with the base portion, thereby forming the housing space H, and a gap 71*c* provided between the upper portions 72A, 72B. An opening 71*b* is formed on the base portion 71*a*.

In assembling, the assembly of the push plates 19, 20 and springs 21 is inserted into the space H from a side of the guide housing 70. The engaging projections 41 of the push plates are projected from the gap 71*c*. The manipulating lugs 38A of the push plates are projected from the guide housing. The slide plate 18 is mounted on the guide housing 70 and engaged with the projections 41 of the push plates in the same manner as the first embodiment.

In order to mount the assembly of the guide housing in the housing 77, the manipulating lugs 38A are pushed at the same time to be retracted in the guide housing, and the guide housing is disposed between the side plates 67A, 67B of the housing 77. The guide housing 70 is positioned so as to coincide the manipulating lugs 38A with the openings 68A and 68B of the housing 77, so that the manipulating lugs 38A are projected from the corresponding openings 68A and 68B by elastic forces of the respective springs 21.

The buckle 6' is connected to the bands 1 and 2 in the same manner as the first embodiment. The engaging and disengaging operations of the buckle 6' and the adjusting operation are performed in the same manners as the first embodiment.

In the adjusting mechanism of the slide plate 18, the shape of the tooth such as ratchet 37 and arc-shaped recess of the teeth 57 of the previous embodiments can be changed to other shapes.

Referring to FIG. 14 showing a modification of the slide plate, a slide plate 18' has a series of teeth 58 each of which is an arc-shaped projection, and is symmetrically formed with the projection of opposite side of the opening 36. Each of the push plates 19, 20 has an engaging projection 50 having an arc-shaped recess 50*a* to be engaged with the arc-shaped projection 58.

In the adjusting operation, if the second band 2 is forcibly pushed or pulled, the opposite teeth 58 slide on the arc-shaped recess 50*a* of the corresponding engaging projections 50 one by one.

Referring to FIG. 15 showing another modification of the adjusting mechanism, the slide plate 18' has the ratchet 37 which is the same as the first embodiment, and a ratchets 37' formed opposite to the ratchet 37. The ratchet 37' has an engaging surface 37'a formed to prevent the relative movement in the band contraction direction. The push plate 19 has the engaging projection 41 engaged with a tooth of the ratchet 37 and the push plate 20 has an engaging projection 41A engaged with a tooth of the ratchet 37'.

In the modification, since the engaging projections 41, 41A are disposed on the push plates in a point symmetry, the push plates are the same in configuration. Thus, one type of the push plate is commonly employed for both the push plates.

In the adjusting operation, since the ratchets 37, 37' of the slide plate 18' are disposed in the reverse relation, the slide plate can not be forcibly pushed or pulled. Consequently, in order to increase or reduce the length of the band, either of the push plates 19, 20 is necessarily pushed.

In order to reduce the length of the band, namely to move the slide plate 18' toward the first band 1, only the push plate 20 is pushed for disengaging the engaging projection 41A from the ratchet 37', and the second band 2 is pushed toward the first band 1. The ratchet 37 slides on the slants 41*b* of the engaging projection 41 of the push plate 19. Thus, the length of the band can be finely shortened.

On the other hand, in order to increase the length, the second band 2 connected to the slide plate 18' is pulled by pushing the push plate 19 only.

It goes without saying that the adjusting operations are performed by pushing both of the push plates at the same time.

FIG. 16 shows a further modification. The slide plate 18' has a series of teeth 59 each of which is a rectangular projection, and symmetrically formed on the opposite sides of the opening. Each of the push plates 19, 20 has a cubic-shaped engaging projection 46 to be engaged with the indentation between teeth 59.

In the adjusting operation, since the slide plate 18' can not be forcibly pushed or pulled, the second band 2 is moved by pushing the push plates 19, 20 at the same time.

When the push plates 19, 20 are pushed, the engaging projections 46 are disengaged from the square teeth 59 of the slide plate 18'. In this state, the second band 2 can be moved to a desired position, and the push plates are released at the desired position so that the engaging projections 46 engage with the corresponding teeth 59. Thus, the length of the band can be finely adjusted.

FIGS. 17, 18 and 19 show further modifications of the push plates and the slide plate of the buckle 6 of first embodiment.

In the buckle shown in FIG. 17, the engaging projection 41 of the push plate 20 is omitted. Other parts are the same as the first embodiment.

In order to disengage the buckle from the lock pin 9, the push plates 19, 20 are pushed at the same time.

However, in order to adjust the length of the band, the slide plate 18 is moved by pushing the push plate 19 only.

Referring to FIG. 18, the slide plate 18' has a single ratchet 37 and a plane edge 37A. The engaging projection 41 of the push plate 20 is abutted on the plane edge 37A.

Therefore, the buckle is disengaged by pushing the push plates 19, 20 at the same time.

However, in order to move the slide plate 18' for adjusting the length, only the push plate 19 is pushed.

FIG. 19 shows a further modification of the buckle having a single push plate. In a push plate 20*a*, the manipulating lugs 38A, the engaging hook 40, and the engaging projection 41 are omitted. In a housing 16', the notch 23 is not formed on the side plate 22B corresponding to the push plate 20*a*. Therefore, when the buckle is assembled, only the push plate 19 is projected.

Thus, the operations of the buckle is performed by the single push plate 19.

The adjusting device of the present invention can be employed for the other types of structure of the watch band such as a double folded band buckle.

FIG. 20 shows another example of the folded band buckle. In the band buckle, the adjustment buckle 6' of the third embodiment is used.

A folding plate member 5' of the band buckle comprises an intermediate connecting plate 80 having a lock pin 80*a* in a central portion thereof, a first connecting plate 81 hinged to an end of the intermediate connecting plate 80, and a second connecting plate 82 hinged to the other end of the intermediate connecting plate 80.

The housing 77 of the adjustment buckle 6' is pivotally connected to the first connecting plate 81 by a pin 83 at holes 69A. The connecting lugs 36A of the slide plate 18 are connected to the connecting link 44 of the second band 2. The second connecting plate 82 is connected to a connecting link 14A of the first band 1.

The first connecting plate 81 and the second connecting plate 82 are folded on the intermediate connecting plate 80. The operation of the adjustment buckle 6' is the same as the previous one.

FIG. 21 shows a fourth embodiment of the watch band having a single lock type band buckle. The adjusting device of the present invention is built into the band buckle. Therefore, the housing for the adjusting device is not provided therein.

A buckle 61 comprises a housing 62 and a cover 75 pivotally connected to an end of the housing. The housing 62 has an upper plate 63 slightly indented from the upper surface of the housing and having an opening 65, a lower housing space 64 laterally formed under the upper plate 63, a connecting portion 62*a* projected from a lower portion of the upper plate, and a cylindrical connecting member 62*b* formed on an end of the connecting portion 62*a*.

The cover 75 comprises a lock pin 76 having a conical head and securely mounted on the underside thereof, and a pair of connecting lugs 75*a* provided opposite to the lock pin 76. The connecting lugs 75*a* are connected with the cylindrical connecting member 62*b* of the housing 62 with a pin so that the cover 75 is pivotally connected to the housing.

A connecting link 14B connected to the first band 1 has an engaging rod 78 laterally provided on an end of the link. The push plates 19 and 20, guide housing 70, and the slide plate 18 are the same as those of FIG. 13. However, the position of each member is inverted.

The push plates 19 and 20, and the springs 21 are assembled in the guide housing 70. The slide plate 18 is connected to the connecting link 44 of the second band 2 at the connecting lugs 36A.

Describing the assembling of the buckle 61, the assembly of the guide housing 70 and the slide plate 18 which is connected to the second band 2 is disposed in the housing space 64 of the housing 62 in the order of inverse of the previous embodiments. In this state, the opening 71*b* of the housing 70 is disposed corresponding to the opening 65 of the upper plate 63 and the manipulating lugs of the respective push plates are laterally projected from the housing space 64. A base plate 79 is engaged with opposite peripheral portions 64*a* of the housing space 64 and secured thereto by pins 79*a*. Thus, the adjusting device is housed in the buckle 61.

The cover 75 is inserted into an opening behind the engaging rod 78 from the underside of the connecting link 14B. The engaging rod 78 is put on the connecting portion 62*a* and the cover 75 is rotated over the engaging rod 78. The cover 75 is pushed to abut on the upper plate 63 of the housing 62 so that the conical head of the lock pin 76 is inserted into the opening 65 and the opening 71*b* of the guide housing 70. The lock pin 76 is engaged with the engaging hooks 40 of the push plates 19, 20 in the same manner as aforementioned. Thus, the cover 75 is locked to the housing 62, thereby connecting the bands 1 and 2 through the buckle 61. The lock pin 76 is released by pushing the push plates at the same time.

The operation for the fine adjustment of the length of the band is the same as the previous embodiments.

In accordance with the present invention, the adjusting device for finely adjusting the length of the watch band is provided in the buckle, and operated by the push plates of the buckle. Thus, the length of the band can be easily changed by the user in dependency on the size of the wrist in the morning and at the evening.

Since the push plates and the slide plate are overlapped with each other, the width and the length of the buckle are reduced to reduce the size of the buckle.

The engaging projections of the push plates are engaged with the adjusting mechanism of the slide plate so that both of the push plates and the slide plate are prevented from removing from the guide housing. Hence there is not provided specific means for stopping the push plates. Thus, the length adjusting device is integrally formed in the buckle without increasing the number of parts at a low cost.

If the teeth of the slide plate are formed at a pitch as small as possible, the length of the band can be adjusted by a very small pitch.

If the shape of the tooth is varied, the operation of the push plates changes with the shape. For example, if the ratchets are employed, it is possible to provide the adjusting device in such a design as the first embodiment wherein the slide plate can be moved in the length reducing direction without pushing the push plates. However, the length of the band can not be increased unless pushing the push plates at the same time. Thus, the band is prevented from accidentally increasing and dropping from the wrist.

If the arc-shaped teeth are employed, the slide plate can be moved in the opposite directions by forcibly pushing and pulling the second band. Thus, the length of the band is easily adjusted.

In the case of the square shape of the tooth, the length is adjusted by pushing the push plates at the same time. In this case, the push plates are the same in configuration, so that one type of the push plate is employed for both of them, thereby reducing the number of parts and manufacturing cost.

Furthermore, if the ratchets of the opposite sides are inversely provided, either of the push plates is pushed for increasing or reducing the length. In this case, the push plates are also the same in configuration, so that one type of the push plate is employed for both of them, thereby reducing the number of parts and manufacturing cost.

In addition, the adjusting device of the present invention can be applied to various types of buckle.

FIGS. 22 and 23 show a fifth embodiment of the present invention. In the embodiment, the adjusting device of FIG. 21 is applied to a bracelet 85.

A buckle 61A comprises a housing 62A and a cover 75A pivotally connected to an end of the housing. The housing 62A has an upper plate 63A slightly indented from the upper surface of the housing and having an opening 65A, a connecting portion 62*c* projected from a lower portion of the upper plate 63A, and a cylindrical connecting member 62*d* formed on an end of the connecting portion 62*c*.

The cover 75A comprises a lock pin 76A, and a pair of connecting lugs 75*b*. The connecting lugs 75*b* are pivotally connected with the cylindrical connecting member 62*d* of the housing 62A.

A connecting link 85*a* connected to an end of the bracelet 85 has an engaging rod 85*b*.

Referring to FIGS. 24 and 25, the push plates 19 and 20, and the slide plate 18 are the same as those of FIG. 21. However, a guide housing 70A has a U-shaped section.

The push plates 19 and 20, and the springs 21 are assembled in the guide housing 70A. The slide plate 18 is connected to the connecting link 44A of the other end of the bracelet 85 at connecting lugs 36B.

The assembling of the buckle 61A is the same as the fourth embodiment of FIG. 21.

In use, the cover 75A is inserted into a space behind the engaging rod 85*b* from the underside of the connecting link 85*a*. The engaging rod 85*b* is put on the connecting portion 62*c* and the cover 75A is rotated over the engaging rod 85*b*. The lock pin 76A is inserted into the opening 65A and engaged with the engaging hooks of the push plates. Thus, the cover 75A is locked to the housing 62A.

The other operation is the same as the fourth embodiment.

FIG. 26 shows a sixth embodiment of the present invention. In the embodiment, the adjusting device of the present invention is applied to a buckle of a belt for pants. The belt comprises a panel 87 having a plurality of punch holes 88, and a buckle 89.

The buckle 89 comprises a housing 62B and a cover 90 pivotally connected to an end of the housing 62B by a pin 90*c*. The housing 62B has an upper plate 63B having an opening 65B.

The cover 90 has an opening 90*a* so as to allow the panel 87 to be inserted therein in the upright position of the cover, a lock pin 91 having a conical head and secured to the underside thereof. Each side plate 90*b* of the cover has a height to form a space 92 between the upper plate 63B and the cover, so that the cover 90 can be rotated and locked in the state when the panel 87 is put on the upper plate 63B as shown in FIG. 27. The lock pin 91 is used as a tongue of the belt, as will be described hereinafter. Therefore, the lock pin has such a length that the conical head thereof passes through the punch hole 88 and engages with the engaging hooks of the push plates 19, 20 as shown in FIG. 27.

The push plates 19 and 20, guide housing 70A and the slide plate 18 are the same as those of the fifth embodiment.

The push plates 19 and 20, and the springs 21 are assembled in the guide housing 70A. The slide plate 18 is connected to an end of the panel 87 by a pin 93.

The assembly of the guide housing 70A and the slide plate 18 is housed in the housing space of the housing 62B in the same order as the fifth embodiment.

In use, the cover 90 is rotated about the pin 90*c* to the upright position as shown in FIG. 26. The tip 87*a* of the panel 87 is inserted in the opening 90*a*. Then, the cover 90 is downwardly rotated, and the lock pin 91 is inserted into a selected one of the punch holes 88. The conical head of the lock pin 91 passes through the holes 88 and 65B and engages with the engaging hooks of the push plates 19 and 20 in the same manner as the previous embodiment.

The fine adjustment operation of the effective length of the belt is the same as the previous one.

FIG. 29 shows a seventh embodiment of the adjusting device employed in a watch band as the personal adornment band according to the present invention. The adjusting device A is provided between a watch band B1 and a watch band B2.

Referring to FIG. 30, the adjusting device A comprises a housing 105, a slide plate 102, a rotary plate 103, and a push plate 104, and a base plate 106.

The housing 105 comprises a top plate 105A, a pair of side plates 105B and 105C formed on the lateral opposite sides with respect to the longitudinal direction of the band, and an end wall plate 105D. Each side plate has a lower notch 105E to be engaged with the base plate 106. In the side plate 105B, a notch 109 is further formed in the notch 105E near the end wall 105D to be engaged with the push plate 104. A blind hole 109A is formed in an inner side of the side plate 105C corresponding to the notch 109. A housing space H is formed in the housing 105 having an opening 105F opposite to the end wall plate 105D.

A band connecting portion 108 having a lateral hole 108A is integrally formed on the end wall plate 105D. The base plate 106 has a guide pin 106A for guiding the push plate 104, a circular opening 107, and a rectangular projecting rib 106B.

The slide plate 102 has a rectangular shape in plane and comprises a flat body 102A and a connecting portion 111 having a pair of connecting lugs 111*a* at an end thereof. Each connecting lug 111*a* has a lateral hole 112. On the flat body 102A, an elongated oblique cam groove 110 is obliquely formed, which will be described hereinafter in detail.

The rotary plate 103 comprises a circular body 103A, a cylindrical supporting shaft 113 provided on the underside of the circular body at the center P of the rotation, and a cam follower 114 provided on the upper portion of the body at a position deviated from the center P. The rotary plate 103 further has an engaging portion comprising a plurality of ratchet teeth 115 formed on the periphery of the body opposite to the cam follower 114.

Referring to FIGS. 32*a* and 32*b*, each ratchet tooth 115 has an engaging surface 115A and a slant surface 115B. The engaging surface 115A is formed along a radial line R of the circular body 103A at a predetermined pitch, and the slant surface 115B is formed between the engaging surfaces.

As shown in FIG. 30, the push plate 104 comprises a pawl 116 formed on a side to be engaged with the ratchet tooth 115 of the rotary plate, and a pin 104A provided on an end for retaining a coil spring 117. The pawl 116 has an engaging portion 116A to be engaged with the engaging surface 115A of the ratchet tooth 115 and a slant portion 116B engaged with the slant surface 115B.

A method for assembling the adjusting device A will be described.

The rotary plate 103 having the cam follower 114 is mounted on the base plate 106 such that the supporting shaft 113 is rotatably engaged with the opening 107 of the base plate. The flat body 102A of the slide plate 102 is mounted on the rotary plate 103, and the cam follower 114 of the rotary plate is engaged with the cam groove 110 of the slide plate. The push plate 104 is disposed in the housing space H and engaged with the notch 109 of the side plate 105B of the housing 105. The spring 117 is provided between the end of the push plate 104 and the hole 109A of the side plate 105C, mounted on the pin 104A. Thus, the push plate 104 is outwardly urged to be projected from the housing 105 at the other end.

The assembly of the base plate 106 and the slide plate 102 is mounted in the housing space H. The connecting portion 111 is exposed from the housing. The push plate 104 is contacted with the periphery of the guide pin 106A of the base plate 106, and the pawl 116 thereof is engaged with the ratchet tooth 115 of the rotary plate 103. The base plate 106 is secured to the lower notches 105E of the respective side plates 105B, 105C at opposite sides by brazing. Thus, the adjusting device A is assembled.

FIGS. 31*a* and 31*b* show the adjusting device A where the slide plate 102 is slid to the outermost position, so that the length fine adjustment is in maximum. In this state, the slant portion 116B of the pawl 116 of the push plate 104 is engaged with the slant surface 115B of the ratchet tooth 115 of the rotary plate 103, and the cam follower 114 of the rotary plate 103 is abutted on a lower end 110*a* of the cam groove 110 of the slide plate 102.

As shown in FIG. 31*a*, the cam groove 110 has a length E and an inclination of angle α to an axial line L passing the center P of the rotary plate and the center of the cam follower 114. The length E and the angle α of the cam groove 110 determine the sliding distance of the slide plate 102.

The pawl 116 of the push plate 104 engages with the ratchet tooth 115 to form an engaging device. The slide plate is prevented from removing from the housing by the cam follower 114.

The connecting portion 108 of the housing 105 is connected to an end link 118 of the band B1 by a pin 119 inserted in the hole 108A. The connecting portion 111 of the slide plate 102 is connected to a connecting link 120 of the band B2 by a pin 121 engaged with holes 112 of the connecting lugs 111*a*. Thus, a band structure C having the adjusting device A is formed.

The operation for finely adjusting the length of the band will be described with reference to FIGS. 33*a*, 33*b*, 33*c* and 33*d*.

Figure 33A:
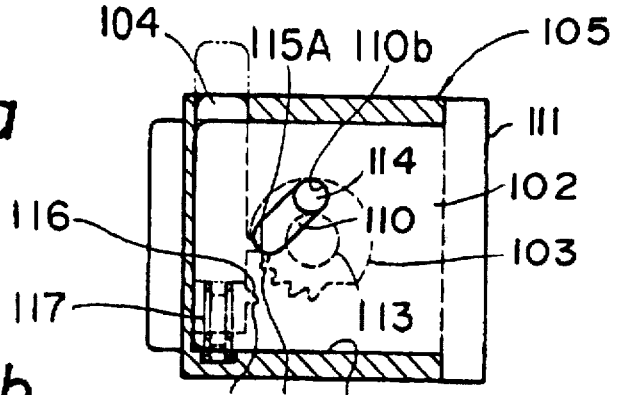

In FIG. 33*a*, the slide plate 102 is at the innermost position so that the length of the band can not be reduced further. In this state, the cam follower 114 is abutted on an upper end 110*b* of the cam groove 110, and the engaging portion 116A of the pawl 116 of the push plate 104 is engaged with the engaging surface 115A of the uppermost tooth (in the figure) of the ratchet tooth 115 of the rotary plate 103. Consequently, the rotary plate 103 can not be rotated, and hence the slide plate 102 cooperating with the rotary plate is regulated from sliding through the cam follower.

In order to increase the length of the band, the push plate 104 is pushed against the elastic force of the spring 117 so as to retract the projected end of the push plate in the housing as shown by the dotted-dash line in FIG. 33*a*. Thus, the pawl 116 is disengaged from the engaging surface 115A of the ratchet tooth.

Figure 33B:
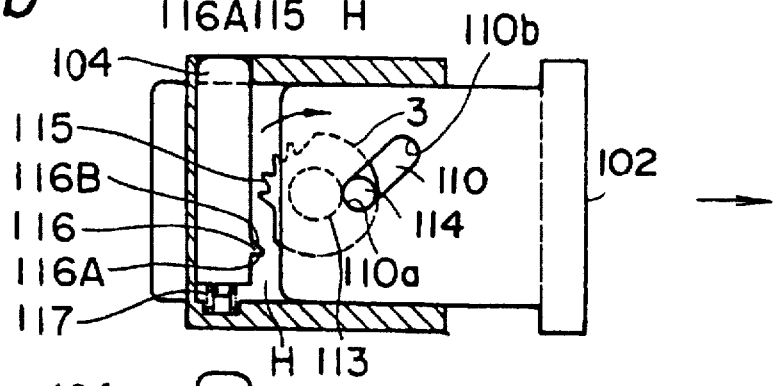

Then, as shown in FIG. 33*b*, the slide plate 102 is outwardly pulled, and the cam groove 110 engaged with the cam follower 114 is also outwardly moved. The cam follower 114 is rotated with the cam groove. Thus, the rotary plate 103 is rotated about the shaft 113 in a clockwise direction shown by an arrow. The rotary plate can be rotated without being interfered by the push plate.

Figure 33C:
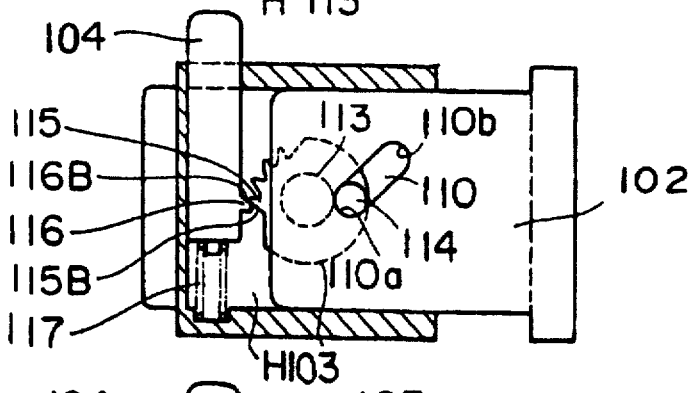

As shown in FIG. 33*c*, when the push plate 104 is released, the push plate is outwardly urged by the spring 117 so that the slant portion 116B of the pawl 116 is engaged with the slant surface 115B of the lowermost ratchet tooth. As aforementioned, the adjusting amount of the length of the band is maximum in this state.

Figure 33D:
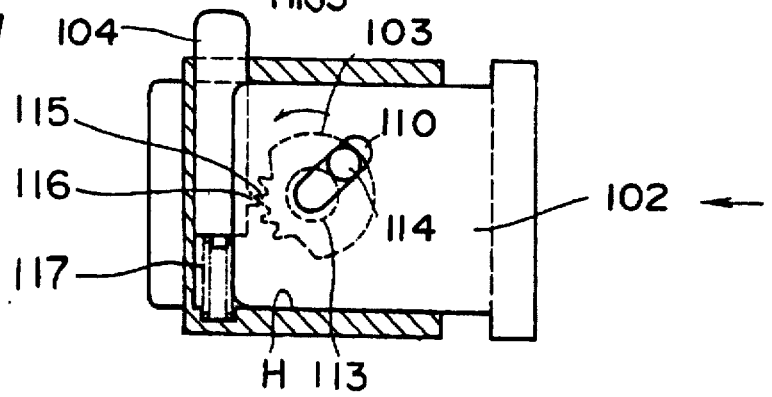

Then, the slide plate 102 is pushed in the housing as shown in FIG. 33*d*. The cam groove 110 is inwardly moved so that the cam follower 114 is rotated, thereby rotating the rotary plate 103 in the counterclockwise direction as shown by an arrow. In the ratchet tooth 115, since the slant surface 115B engages with the slant portion 116B of the pawl, the ratchet tooth can be slid on the pawl 116. Thus, the rotary plate 103 can be rotated.

If the slide plate 102 is stopped at a desired position, the pawl 116 engages with the engaging surface 115A of the ratchet tooth 115 by the urging force of the sprig 117 so that the slide plate 102 is locked at the position. Thus, the length of the band is adjusted. By pushing the slide plate at a predetermined pitch, the length of the band is reduced step by step.

The length of the band is reduced without being interfered by the push plate. More particularly, when the slide plate 102 is at the outermost position as shown in FIG. 33*c*, the push plate 104 is pushed to disengage the pawl 116 from the ratchet tooth 115 as shown in FIG. 33*b*. When the slide plate 102 is pushed in this state, the rotary plate 103 can be rotated irrespective of the push plate 104. Then, the push plate 104 is released at a desired position of the slide plate, and the pawl 116 is engaged with a corresponding tooth of the ratchet teeth 115.

There is a limit for manufacturing the ratchet tooth 115 to a very small pitch. However, in the embodiment, even if the rotary plate is largely rotated because of a large pitch of the ratchet tooth, the slide plate 102 cooperating with the rotary plate is moved by a small distance because of the inclination of the cam groove 110. Thus, the length of the band is finely adjusted by the slide plate.

FIGS. 34 and 35 show an eighth embodiment of the adjusting device of the present invention. An adjusting device A' comprises a housing 125, a slide plate 122, a rotary plate 123, a push plate 124, and a base plate 126.

Referring to FIG. 36, the housing 125 comprises a top plate 125A, a pair of side plates 125B, 125C formed in the lateral direction and an end wall plate 125D. One of the side plates 125B has a lower notch 127, and a pair of shoulders 128A formed on opposite sides of the notch 127 to be engaged with the base plate 126. The other side plate 125C has a lower notch 128B to be engaged with the base plate 126, and a pair of blind holes 129 formed in the inner wall thereof.

A band connecting portion 130 having a lateral hole 130A is integrally formed on the end wall plate 125D.

Referring to FIG. 37, the base plate 126 has a circular opening 131, and a pair of rectangular projecting ribs 126B. The base plate 126 is secured to the shoulders 128A and the notches 128B of the housing 125. The housing 125 has the housing space H having an opening 125E formed opposite to the end wall plate 125D. As shown in FIGS. 35*a* and 35*b*, a rectangular opening 132 is formed between the notch 127 of the housing 125 and the base plate 126.

Referring to FIG. 34, the slide plate 122 has a rectangular shape in plane and comprises a flat body 122A and a connecting portion 139 having a pair of connecting lugs 139*a*. Each connecting lug 139*a* has a lateral hole 139A. On the flat body 122A, an elongated cam groove 138 is obliquely formed. As shown in FIG. 35*a*, the cam groove 138 is inclined at the angle α to the line L in the opposite direction to the cam groove 110 of the seventh embodiment.

Referring to FIGS. 39*a* and 39*b*, the rotary plate 123 comprises a circular body 123A, a cylindrical supporting shaft 123B provided on the underside of the circular body at the center P of the rotation, and a cam follower 134 provided on the upper portion of the body at a position deviated from the center P. The rotary plate 123 further has an engaging portion comprising a plurality of ratchet teeth 135 formed on the periphery of the body opposite to the cam follower 134. Each ratchet tooth 135 has an engaging surface 135A and a slant surface 135B. The engaging surface 135A is formed along a radial line R of the circular body 123A at a predetermined pitch and the slant surface 135B is formed between the engaging surfaces 135A.

Referring to FIG. 38, the push plate 124 is formed in a square shape, and has a manipulating portion 124A at an end, and a pair of notches 124B formed on the other end for coil springs 137. An opening 133 is formed in a central portion of the push plate for receiving the rotary plate 123 therein. The opening 133 has a shape combining a semi-circular portion 133A formed near the notches and a square portion 133B formed near the manipulating portion. On the semi-circular portion 133A, a pawl 136 is formed in a central portion thereof to be engaged with the ratchet tooth 135 of the rotary plate 123. The pawl 136 has an engaging portion 136A engaged with the engaging surface 135A of the ratchet tooth 135 and a slant portion 136B engaged with the slant surface 135B.

A method for assembling the adjusting device will be described.

The supporting shaft 123B of the rotary plate 123 having the cam follower 134 is mounted in the opening 131 of the base plate 126. The push plate 124 is mounted on the base plate 126 between the projecting ribs 126B, and the rotary plate 123 is disposed in the opening 133. The rotary plate 123 is positioned such that the pawl 136 of the push plate 124 is engaged with the ratchet tooth 135 of the rotary plate. The slide plate 122 is mounted on the push plate 124, and the cam follower 134 of the rotary plate is engaged with the cam groove 138 of the slide plate.

The assembly of the base plate 126 is mounted in the housing space H of the housing 125. The connecting portion 139 of the slide plate 122 is exposed from the housing. The push plate 124 is engaged with the notch 127 of the side plate 125B. The springs 137 are disposed between the notches 124B and the holes 129 of the side plate 125C so that the push plate 124 is outwardly urged to project the manipulating portion 124A from the housing. The base plate 126 is secured to the side plates 125B, 125C by brazing. Thus, the adjusting device is assembled.

The pawl 136 of the push plate 124 engages with the ratchet tooth 135 to form an engaging device. The slide plate 122 is prevented from removing from the housing by the cam follower 134. The length E and the angle $\alpha$ of the cam groove 138 determine the sliding distance of the slide plate 122.

The connecting portion 130 of the housing 125 is connected to the end link 118 of the band B1 and the connecting portion 139 of the slide plate 122 is connected to the connecting link 120 of the band B2.

The operation for finely adjusting the length of the band will be described with reference to FIGS. 40*a*, 40*b*, 40*c* and 40*d*.

Figure 40A:
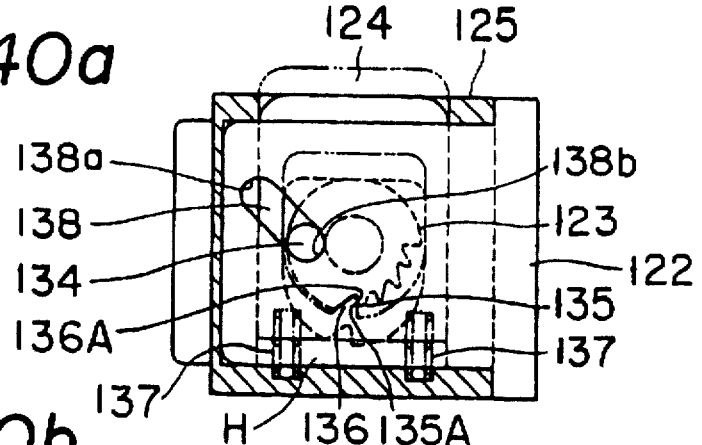

In FIG. 40*a*, the slide plate 122 is at the innermost position so that the length of the band can not be reduced further. In this state, the cam follower 134 is abutted on a lower end 138*b* of the cam groove 138 and the engaging portion 136A of the pawl 136 of the push plate 124 is engaged with the engaging surface 135A of the left end tooth of the ratchet teeth 135 of the rotary plate 123.

In order to increase the length of the band, the push plate 124 is pushed against the elastic forces of the springs 137 so as to retract the manipulating portion of the push plate in the housing as shown by the dotted-dash line in FIG. 40*a*. Thus, the pawl 136 is disengaged from the engaging surface 135A of the ratchet tooth.

The push plate 124 can be pushed until the inner end is abutted on the inner wall of the side plate 125C. In the push plate, the opening 133 is formed to provide a slight gap between the square portion 133B and the rotary plate 123 when the push plate is pushed. Thus, the rotary plate 123 is prevented from engaging from the push plate so as to be smoothly rotated.

Figure 40B:
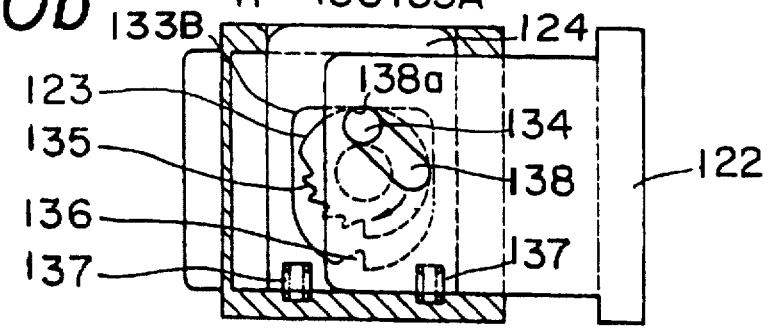

Then, as shown in FIG. 40*b*, the slide plate 122 is pulled, and the cam groove 138 engaged with the cam follower 134 is also outwardly moved. The cam follower 134 is rotated with the cam groove. Thus, the rotary plate 123 is rotated about the shaft 123B in a clockwise direction shown by an arrow.

Figure 40C:
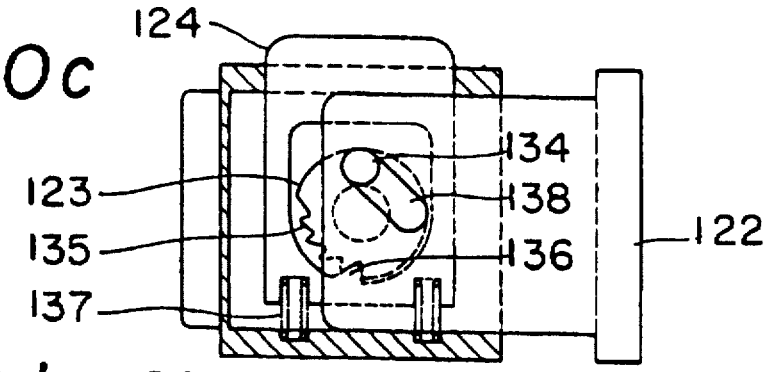

In FIG. 40*c*, when the push plate 124 is released, the push plate is outwardly urged by the springs 137 so that the slant portion 136B of the pawl 136 is engaged with the slant surface 135B of the outermost ratchet tooth. In this state, the cam follower 134 of the rotary plate 123 is abutted in an upper end 138*a* of the cam groove 138 of the slide plate 122.

Figure 40D:
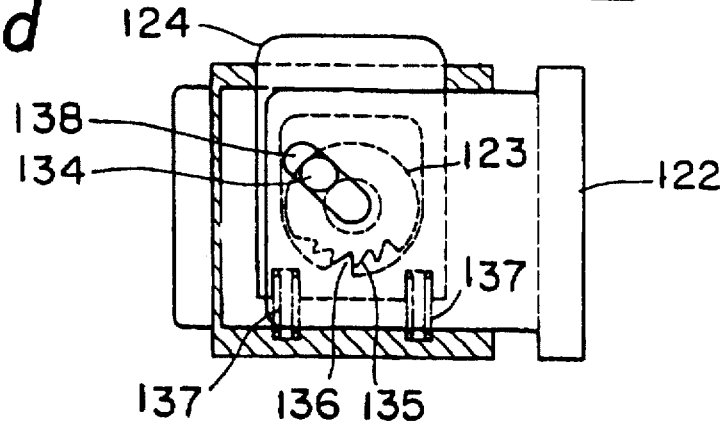

Then, the slide plate 122 is pushed in the housing as shown in FIG. 40*d*. The cam groove 138 is inwardly moved so that the cam follower 134 is rotated, thereby rotating the rotary plate 123 in the counterclockwise direction as shown by an arrow. In the ratchet tooth 135, since the slant surface 135B engages with the slant portion 136B of the pawl, the ratchet tooth can be slid on the pawl 136. Thus, the rotary plate 123 can be rotated.

If the slide plate 122 is stopped at a desired position, the pawl 136 engages with the engaging surface 135A of the ratchet tooth 135 by the urging forces of the sprigs 137 so that the slide plate 122 is locked at the position. Thus, the length of the band is adjusted. By pushing the slide plate at a predetermined pitch, the length of the band is reduced step by step.

If the push plate 124 is pushed when the slide plate 122 is at the outermost position as shown in FIG. 40*c*, the pawl 136 of the push plate 124 is disengaged from the ratchet tooth 135. When the slide plate 122 is pushed in this state, the rotary plate 123 can be rotated. Then, the push plate 124 is released at a desired position of the slide plate, and the pawl 136 is engaged with a corresponding ratchet tooth 135.

FIGS. 41 and 42 show a ninth embodiment of the present invention. An adjusting device comprises a housing 141, a slide plate 142, a rotary plate 143, a push plate 144, and base plate 126.

Since the housing 141, base plate 126 and the slide plate 142 are the same in construction and operation as those of the eighth embodiment, the same parts thereof are identified with the same reference numerals and the detailed descriptions thereof are omitted.

The rotary plate 143 comprises a circular body 143A, a cylindrical supporting shaft 145 provided on the underside of the circular body at the center P of the rotation, and a cam follower 146 provided on the upper portion of the body at a position deviated from the center P. The rotary plate 143 further has only one tooth 147 formed on the periphery of the body opposite to the cam follower 146. The tooth 147 has an engaging portion 147A and a slant portion 147B.

The push plate 144 has a manipulating portion 144A at an end, and a pair of notches 148 formed on the other end for coil springs 140. An opening 149 is formed in a central portion of the push plate for receiving the rotary plate 143 therein. The opening 149 has a shape combining a semi-circular portion 149A formed near the notches and a square portion 149B formed near the manipulating portion. On the semi-circular portion 149A, a lock means comprising a plurality of pawls 150 is formed in a central portion thereof to be engaged with the tooth 147 of the rotary plate 143. Each pawl 150 has an engaging surface 150A and a slant surface 150B.

As shown in FIG. 42*a*, the engaging surface 150A is formed along a radial line R of the circular body 143A at a predetermined pitch and the slant surface 150B is formed between the engaging surfaces 150A.

Method for assembling the adjusting device will be described.

The supporting shaft 145 of the rotary plate 143 having the cam follower 146 is mounted in the opening 131 of the base plate 126. The push plate 144 is mounted on the base plate 126 between the projecting ribs 126B, and the rotary plate 143 is disposed in the opening 149. The rotary plate 143 is positioned such that the tooth 147 is engaged with the pawl 150 of the push plate 144. The slide plate 142 is mounted on the push plate 144, and the cam follower 146 of the rotary plate is engaged with the cam groove 138 of the slide plate.

The assembly of the base plate 126 is mounted in the housing space H of the housing 141. The push plate 144 is engaged with the notch 127 and the springs 140 are disposed between the notches 148 and the holes 129 of the side plate so that the push plate 144 is outwardly urged to project the manipulating portion 144A from the housing. The base plate 126 is secured to the housing 141 by brazing. Thus, the adjusting device is assembled.

The tooth 147 of the rotary plate 143 engages with the pawl 150 of the push plate 144 to form an engaging device. The slide plate 142 is prevented from removing from the housing by the cam follower 146 and the pawl.

The adjusting device is connected to the bands B1 and B2 in the same manner as the previous embodiment. Therefore, the detailed description thereof is omitted.

The operation for finely adjusting the length of the band will be described with reference to FIGS. 43*a*, 43*b*, 43*c* and 43*d*.

Figure 43A:
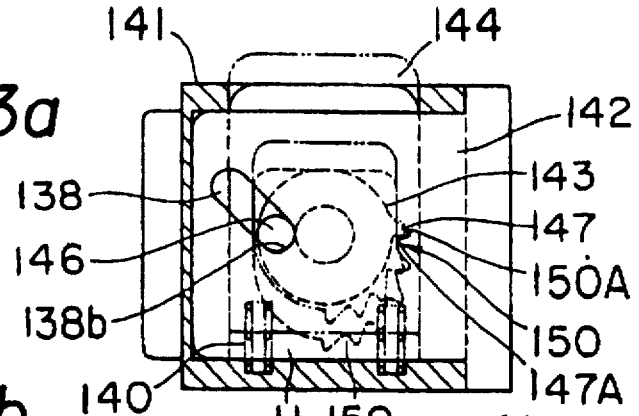

In FIG. 43*a*, the slide plate 142 is at the innermost position. In this state, the cam follower 146 is abutted on the lower end 138*b* of the cam groove 138 and the engaging portion 147A of the tooth 147 of the rotary plate 143 is engaged with the engaging surface 150A of the upper end pawl 150 of the push plate 144.

Figure 43B:
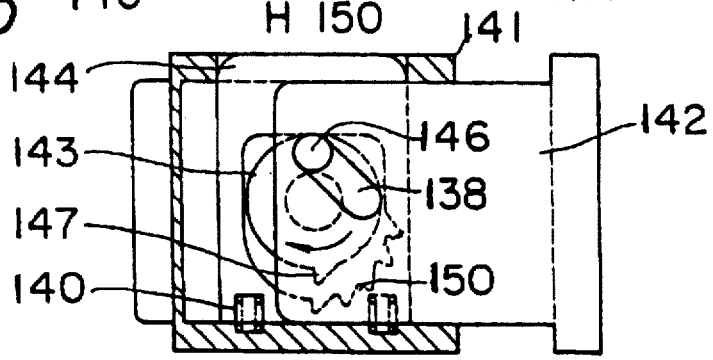

In order to increase the length of the band, the push plate 144 is pushed as shown by the dotted-dash line in FIG. 43*a*. Then, as shown in FIG. 43*b*, the slide plate 142 is pulled, and the cam groove 138 engaged with the cam follower 146 is outwardly moved. The cam follower 146 is rotated by the inner periphery of the cam groove. Thus, the rotary plate 143 is rotated about the shaft 145 in a clockwise direction.

Figure 43C:
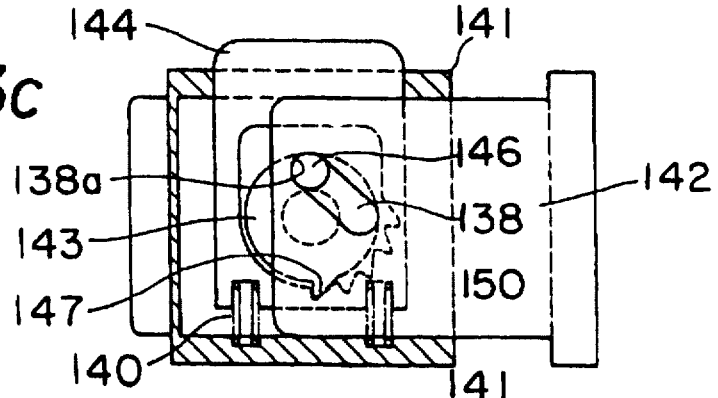

As shown in FIG. 43*c*, when the push plate 144 is released, the push plate is outwardly urged by the springs 140 so that the slant portion 147B of the tooth 147 is engaged with the slant surface 150B of the lower end pawl. In this state, the cam follower 146 of the rotary plate 143 is abutted in the upper end 138*a* of the cam groove 138 of the slide plate 142.

Figure 43D:
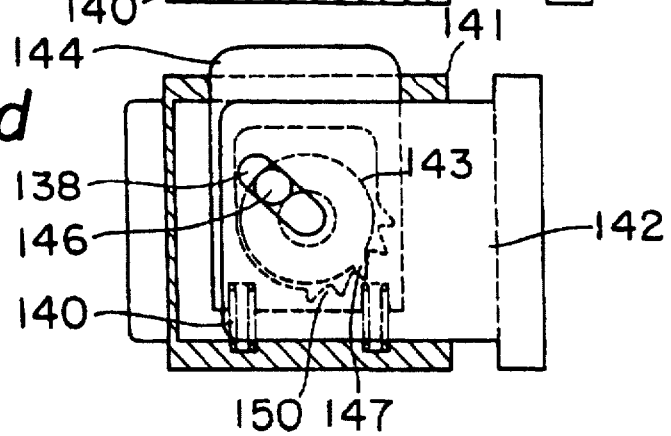

Then, the slide plate 142 is pushed in the housing as shown in FIG. 43*d*. The cam groove 138 is moved to rotate the cam follower 146, thereby rotating the rotary plate 143 in the counterclockwise direction. The slant portion 147B of the tooth 147 can be slid on the slant surface 150B of the pawl 150 of the push plate one by one.

If the slide plate 142 is stopped at a desired position, the tooth 147 engages with the engaging surface 150A of the pawl 150 by the urging forces of the sprigs 140 so that the slide plate 142 is locked at the position. By pushing the slide plate at a predetermined pitch, the length of the band is reduced.

The length of the band is reduced without being interfered by the push plate. If the push plate 144 is pushed when the slide plate 142 is positioned at the outermost position as shown in FIG. 43*c*, the pawl 150 of the push plate 144 is disengaged from the tooth 147 of the rotary plate 143. When the slide plate 142 is pushed in this state, the rotary plate 143 can be rotated. Then, the push plate 144 is released at a desired position of the slide plate, and the tooth 147 is engaged with a corresponding pawl 150.

FIGS. 44 and 45 show a tenth embodiment of the present invention. An adjusting device comprises a housing 151, a slide plate 152, a rotary plate 153, a push plate 154, a leaf spring 160 having a V-shape in plane, and the base plate 126.

In the housing 151, the side plate 125C has a rectangular recess 129*a* for the leaf spring 160.

Other parts of the housing 151 are the same as the housing 141 of the previous embodiment and the same parts are identified with the same reference numerals and the detailed description thereof is omitted.

The slide plate 152 has a drive pin 152A projected downwardly, and a band connecting portion 152*a* having a connecting lugs 152B. Each connecting lug 152B has a hole 152C.

The rotary plate 153 has a circular body 153A, a cylindrical supporting shaft 153B provided on the underside of the circular body at the center P of the rotation, and a drive hole 155 formed on the body at a position deviated from the center P. The rotary plate 153 further has an engaging portion comprising a plurality of rectangular teeth 156 formed on the periphery of the body opposite to the drive hole 155.

The push plate 154 has a manipulating portion 154A at an end, and a notch 157 formed on the other end for the leaf spring 160. In a central portion of the push plate, a recess 158 is formed for receiving the rotary plate 153 therein. The recess 158 has a shape combining a semi-circular portion 158A formed near the notch 157, and a square portion 158B formed near the manipulating portion 154A. On the semi-circular portion 158A, a pawl 159 having a square shape is formed in a central portion thereof. The recess 158 further has an elongated opening 158C formed in a central portion thereof in the lateral direction of the band.

The push plate 154 is mounted on the base plate 126 between the projecting ribs 126B, and the rotary plate 153 is mounted in the recess 158 of the push plate. The supporting shaft 153B of the rotary plate is inserted into the opening 158C of the recess 158 and inserted in the opening 131 of the base plate 126. The pawl 159 of the push plate 154 is engaged with one of the teeth 156 of the rotary plate. The slide plate 152 is mounted on the push plate 154 having the rotary plate 153, and the drive pin 152A of the slide plate is slidably engaged with the drive hole 155 of the rotary plate 153.

The assembly of the base plate 126 is mounted in the housing space H of the housing 151. The push plate 154 is engaged with the notch 127 of the side plate 125B. The leaf spring 160 is disposed between the notch 157 of the push plate and the recess 129*a* of the side plate 125C so that the push plate 154 is outwardly urged to project the manipulating portion 154A from the opening 132 (FIG. 45*a*). The base plate 126 is secured to the side plates 125B, 125C. Thus, the adjusting device is assembled.

The operation for finely adjusting the length of the band will be described with reference to FIGS. 46*a*, 46*b*, 46*c* and 46*d*.

Figure 46A:
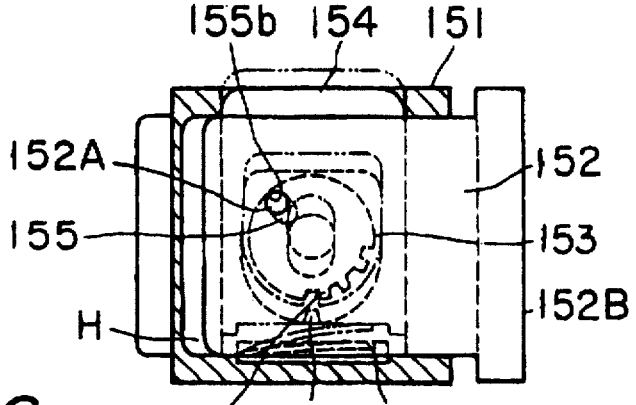

In FIG. 46*a*, the slide plate 152 is at the innermost position. In this state, the drive pin 152A is abutted on an end 155*b* of the drive hole 155 and the pawl 159 of the push plate 154 is engaged with the left end tooth 156 of the rotary plate 153.

In order to increase the length of the band, the push plate 154 is pushed so that the pawl 159 is disengaged from the tooth 156.

In the push plate 154, the opening 158C is formed to be elongated in the lateral direction. Thus, when the push plate is pushed, the push plate can be moved along the supporting shaft 153B of the rotary plate 153.

The pushing distance of the push plate is determined by the opening 158C.

Figure 46B:
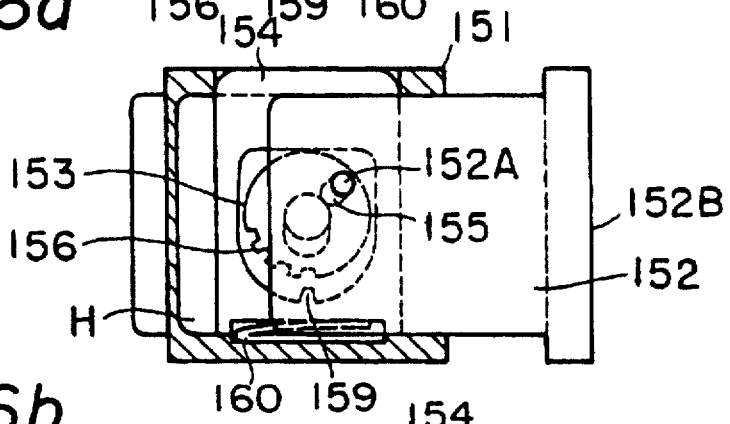

Then, as shown in FIG. 46*b*, the slide plate 152 is pulled, and the drive pin 152A is outwardly moved. Thus, the rotary plate 153 is rotated about the shaft 153B in a clockwise direction.

Figure 46C:
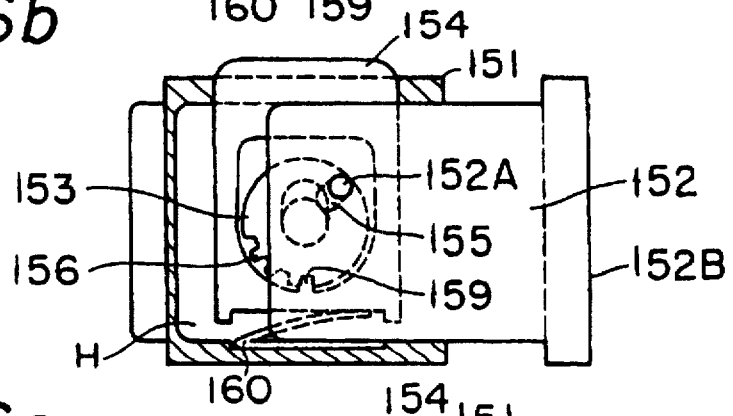
Figure 46D:
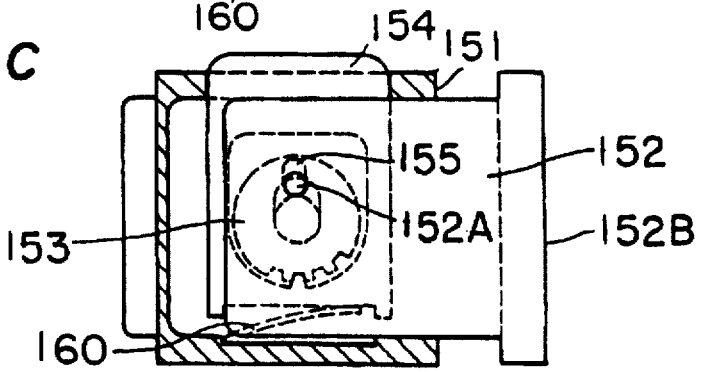

As shown in FIG. 46*c*, when the push plate 154 is released, the push plate is outwardly urged by the spring 160 so that the pawl 159 is engaged with the tooth 156. In this state, the drive pin 152A of the slide plate 152 is abutted in the upper end of the drive hole 155 of the rotary plate 153 in a position opposite to that shown in FIG. 46*a*.

In order to finely reduce the length of the band, if the push plate 154 is pushed when the slide plate 152 is positioned at the outermost position as shown in FIG. 46*c*, the pawl 159 is disengaged from the tooth 156 of the rotary plate 153. When the slide plate 152 is pushed in this state, the rotary plate 153 can be rotated. Then, the push plate 154 is released at a desired position of the slide plate, and the pawl 159 is engaged with a corresponding tooth 156.

The adjusting device of the present invention can be connected to a buckle of a watch band as a personal adornment band.

FIG. 47 shows an example of the adjusting device connected to a triple-folded band buckle 161 for coupling the watch bands B1 and B2. In the example, the adjusting device A' of the eighth embodiment of FIG. 34 is used.

The buckle 161 comprises a cover 162, a middle plate 163 pivotally connected to an end of the cover 162 with a pin 165, and a bottom plate 164 pivotally connected to the middle plate 163 with a pin 166. The bottom plate 164 has an engaging lug 167 at the other end to be engaged with an engaging portion 168 provided on the pin 165 of the cover 162.

The other end of the cover 162 is connected to the connecting portion 130 of the adjusting device by a pin 169. The connecting portion 139 of the slide plate 122 is connected to a connecting link 170 of the band B1 by a pin 170A. The bottom plate 164 is connected to a connecting link 171 of the band B2 by a pin 172. The other ends of the bands B1 and B2 are connected to a watch (not shown). Thus, an annular band structure is formed.

The length of the band is adjusted in the same manners as shown in FIGS. 40*a* to 40*d*. After adjustment, the watch band is put on the wrist of the user. The middle plate 163 is folded on the bottom plate 164 to engage the engaging projection 167 with the engaging portion 168. Thus, the buckle is locked.

If the size of the wrist changes, the push plate 124 is pushed so as to finely adjust the length step by step. The length can be adjusted without taking off the band.

Any of the adjusting devices of the seventh, ninth and tenth embodiments may be used.

FIG. 48 shows the adjusting device A' connected to a watch case 174 of a wrist watch 173. The watch case 174 has a pair of connecting portions 175 and 176 formed on opposite sides thereof in 12 and 6 o'clock directions. The connecting portion 130 of the adjusting device A' is pivotally connected to the connecting portion 175 with a pin 177, and the connecting portion 139 of the slide plate 122 is connected to a connecting link 178 of the band B1 by a pin 179. The other connecting portion 176 of the watch case 174 is pivotally connected to a connecting link 180 of the band B2 by a pin 181.

The length of the band is adjusted in the same manners as shown in FIGS. 40*a* to 40*d*. After adjustment, the watch band is put on the wrist of the user.

From the foregoing, it will be seen that the adjusting device is connected to the personal adornment band in various manners. For example, in the wrist watch, the adjusting device is connected to the watch case, band or buckle. Alternatively, the adjusting device may be connected to a link of the band. Furthermore, the adjusting device may be provided in the watch case, buckle or link of the band.

FIG. 49 shows the adjusting device A' provided for a bracelet 182 as the personal adornment band. The connecting portion 130 of the adjusting device is connected to an end of the bracelet 182, and the connecting portion 139 is connected to the other end by a pin 183.

The bracelet 182 is put on the wrist of the user, and the length of the bracelet is adjusted in the same manners as FIGS. 40*a* to 40*d* without taking off the bracelet. If the size of the wrist changes, the push plate 124 is pushed so as to finely adjust the length step by step. The length can be adjusted without taking off the bracelet.

FIG. 50 shows the adjusting device A' provided for a belt as the personal adornment band. The belt comprises a panel 184, and a buckle 185 having a tongue 186 rotatably connected to a base portion thereof. A plurality of punch holes 187 are formed on the other end of the panel 184 at a predetermined distance to be engaged with the tongue 186.

The connecting portion 139 of the slide plate 122 of the adjusting device is connected to an end of a link 184A of the panel 184 by a pin 188, and the connecting portion 130 is connected to the base portion of the buckle 185 by a pin 189 together with the tongue 186.

The belt is belted on the trousers of the wearer, and the length of the belt is adjusted in the same manners as FIGS. 40*a* to 40*d* without taking off the belt.

If the size of the waist is increased, for example, after having the meal, the adjusting device is operated so as to slightly loosen the belt without taking off the belt. It is possible to finely adjust the length compared with changing the punch hole.

The adjusting device can be employed for a watch band made of leather.

In accordance with the present invention, the slide plate is cooperated with the rotary plate through a cam device. The push plate is engaged with the rotary plate through the engaging device so as to prevent the rotary plate from rotating. When the push plate is pushed, the engaging device is disengaged so that the rotary plate is rotated, and the slide plate can be moved in the longitudinal direction.

When the slide plate is pulled from the housing, the length of the band is increased. When the slide plate is pushed to the housing, the length of the band is reduced. The sliding of the slide plate is regulated in accordance with the engaging device, thereby obtaining a proper length. Thus, the length of the band can be easily and finely adjusted in dependency on the size of the wrist in the morning and at the evening.

The rotation of the rotary plate is regulated at a predetermined angle to regulate the sliding of the slide plate at a predetermined distance. Thus, the length of the band can be easily and finely adjusted.

There is a limit for manufacturing the ratchet teeth to a very small pitch. However, in the embodiments, even if the rotary plate is largely rotated because of a large pitch of the ratchet teeth, the slide plate cooperating with the rotary plate can be slid by a small distance because of the cam device. Thus, the length of the band is finely adjusted by the slide plate.

Since the slide plate is overlapped with the push plate and the rotary plate, the size of the adjusting device is reduced.

Furthermore, if the rotary plate is mounted in the opening of the push plate, the thickness of the adjusting device is reduced to reduce the size.

PROBABILITY OF INDUSTRIAL EXPLOITATION

In accordance with the present invention, the length of the personal adornment band can be easily and finely adjusted by the user in dependency on change in size of the wrist, neck and waist from the size in the morning and to the size at the evening.

I claim:

1. A device for finely adjusting the effective length of a personal adornment band having opposed ends and rough adjusting means having a predetermined adjusting pitch for roughly adjusting the length thereof, said device comprising:

a housing connected to the personal adornment band at one end thereof;

a slide plate slidably mounting in the housing so as to be moved in a longitudinal direction of the band, and connected to the other end of the band;

tooth means formed on a first movable member provided in the housing, and operatively connected to the slide plate;

the tooth means having means for providing a plurality of stopping positions within the adjusting pitch of the rough adjusting means;

lock means formed on a second movable member provided in the housing;

resilient means for engaging the tooth means and the lock means with each other at a position selected from a plurality of the stopping positions dependent on the tooth means, whereby the effective length of the band is adjusted.

2. The device according to claim 1 wherein the tooth means are ratchet teeth.

3. The device according to claim 1 wherein the tooth means are formed by a series of arc-shaped recesses.

4. The device according to claim 1 wherein the tooth means are a series of arc-shaped projections.

5. The device according to claim 1 wherein the tooth means are a series of rectangular projections.

6. The device according to claim 1 wherein the housing forms a part of a buckle of the band.

7. The device according to claim 1 wherein the first movable member is integral with the slide plate.

8. The device according to claim 7 wherein the tooth means is formed on the slide plate.

9. The device according to claim 8 wherein the tooth means are a plurality of teeth formed on an inside wall of a hole formed in the slide plate, and arranged in the longitudinal direction.

10. The device according to claim 9 wherein the tooth means are formed on opposite inside walls of the hole, and the lock means are projections formed on a pair of push plates which are provided to be laterally moved as the second movable member.

11. The device according to claim 9 wherein the tooth means are ratchet teeth.

12. The device according to claim 1 wherein the second movable member is a push plate provided to be laterally moved with respect to the longitudinal direction of the band.

13. The device according to claim 12 wherein the lock means is provided on the push plate.

14. The device according to claim 1 wherein the first movable member is a rotary plate rotatably mounted in the housing.

15. The device according to claim 14 wherein the tooth means is formed on a periphery of the rotary plate.

16. The device according to claim 15 wherein the second movable member is a push plate, and the lock means is a pawl formed on the push plate.

17. A device for finely adjusting length of a personal adornment band, the band having opposed ends and rough adjusting means for roughly adjusting the length thereof, said device comprising:

a housing connected to the personal adornment band at one end thereof;

a slide plate slidably mounted in the housing so as to be moved in a longitudinal direction of the band, and connected to the other end of the band;

tooth means formed on one of a first movable member and a second movable member provided in the housing, and having a pitch shorter than an adjusting pitch of the rough adjusting means;

lock means formed on the other movable member;

resilient means for engaging the tooth means and the lock means with each other at a position selected from a plurality of positions dependent on the tooth means, whereby the length of the band is adjusted, said first movable member being a rotary plate rotatable mounted in the housing, the lock means being a plurality of pawls formed on an inside periphery of a hole formed in a push plate provided to be laterally moved with respect to the longitudinal direction, the tooth means being a tooth formed on the periphery of the rotary plate, and further comprising cam means provided on the slide plate and the rotary plate for rotating the rotary plate by the movement of the slide plate.

18. A device for finely adjusting length of a personal adornment band, the band having opposed ends and rough adjusting means for roughly adjusting the length thereof, said device comprising:

a housing connected to the personal adornment band at one end thereof;

a slide plate slidably mounted in the housing so as to be moved in a longitudinal direction of the band, and connected to the other end of the band;

tooth means formed on one of a first movable member and a second movable member provided in the housing, and having a pitch shorter than an adjusting pitch of the rough adjusting means;

lock means formed on the other movable member;

resilient means for engaging the tooth means and the lock means with each other at a position selected from a plurality of positions dependent on the tooth means, whereby the length of the band is adjusted, said first movable member being a rotary plate rotatably mounted in the housing, said tooth means being formed on a periphery of the rotary plate, and cam means provided on the slide plate and the rotary plate for rotating the rotary plate by the movement of the slide plate.

19. The device according to claim 18 wherein the cam means comprises an oblique cam groove, and a cam follower slidably mounted in the cam groove.

20. The device according to claim 19 wherein the tooth means comprises ratchet teeth provided to prevent expansion of the band.

21. The device according to claim 20 wherein the cam groove is formed in the slide plate, and the cam follower is provided on the rotary plate.

22. A device for adjusting length of a personal adornment band, the band having opposed ends and rough adjusting means having a predetermined adjusting pitch for roughly adjusting the length thereof, said device comprising:

a housing connected directly or indirectly to the personal adornment band at one end thereof;

a slide plate having an opening and being slidable mounted in the housing so as to be moved in a longitudinal direction of the band, and connected to the other end of the band;

a pair of push plates provided in the housing so as to be laterally moved with respect to the longitudinal direction of the band;

said slide plate opening having longitudinal inside edges, tooth means formed on at least one of said longitudinal inside edges of the opening of the slide plate, the tooth means having a pitch shorter than the predetermined adjusting pitch of the rough adjusting means, and defining a plurality of stopping positions within the length defined by said predetermined adjusted pitch of said rough adjustment means of said band;

engaging means formed on at least one of the push plates;

resilient means for engaging the engaging means with the tooth means at a position selected from the plurality of stopping positions dependent on the tooth means, whereby the effective length of the band is adjusted.

23. A device for adjusting length of a personal adornment band, the band having opposed ends and rough adjusting means having a predetermined adjusting pitch for roughly adjusting the length thereof, said device comprising:

a housing connected directly or indirectly to the personal adornment band at one end thereof;

a slide plate slidably mounted in the housing so as to be moved in a longitudinal direction of the band, and connected to the other end of the band;

a push plate provided in the housing so as to be laterally moved with respect to the longitudinal direction of the band;

a rotary plate rotatably mounted in the housing;

cam means provided on the slide plate and the rotary plate for rotating the rotary plate by longitudinal movement of the slide plate;

tooth means formed on the rotary plate;

lock means formed on the push plate for engagement with the tooth means;

resilient means for urging the push plate in a direction to engage the lock means with the tooth means;

the tooth means and the lock means being arranged for stopping the rotary plate at any one of a plurality of stopping positions within a length defined by said predetermined adjusting pitch of said rough adjustment means of said band so that the slide plate is stopped at one of a plurality of positions within one adjusting pitch of the rough adjusting device, whereby the effective length of the band is adjusted.

* * * * *